US007593027B2

(12) United States Patent
Sawai et al.

(10) Patent No.: US 7,593,027 B2
(45) Date of Patent: Sep. 22, 2009

(54) IMAGE GENERATING APPARATUS

(75) Inventors: Kunio Sawai, Daito (JP); Takahiro Naito, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 69 days.

(21) Appl. No.: 12/027,660

(22) Filed: Feb. 7, 2008

(65) Prior Publication Data

US 2008/0192106 A1 Aug. 14, 2008

(30) Foreign Application Priority Data

Feb. 8, 2007 (JP) ..... 2007-28677

(51) Int. Cl.
*B41J 2/32* (2006.01)
*B41J 29/00* (2006.01)

(52) U.S. Cl. ..... 347/222; 400/691

(58) Field of Classification Search ..... 347/222; 400/691

See application file for complete search history.

(56) References Cited

U.S. PATENT DOCUMENTS 7,286,151 B2 * 10/2007 Sawai ..... 347/197
7,369,146 B2 * 5/2008 Maruyama ..... 347/197
7,453,483 B2 * 11/2008 Chikumoto et al. ..... 347/222
2004/0080604 A1 4/2004 Ito

FOREIGN PATENT DOCUMENTS

| | | | |
|---|---|---|---|
| JP | 6-317975 | A | 11/1994 |
| JP | 8-225182 | A | 9/1996 |
| JP | 2001-271826 | A | 10/2001 |
| JP | 2004-114588 | A | 4/2004 |
| JP | 2005-219310 | A | 8/2005 |

* cited by examiner

*Primary Examiner*—Huan H Tran
(74) *Attorney, Agent, or Firm*—Crowell & Moring LLP

(57) ABSTRACT

This image generating apparatus includes a chassis and a side plate, a cartridge stop member provided on a first side surface of the chassis integrally has a first shaft stop portion coming into contact with a first end surface of a shaft of a print head pressing member, and a side plate provided on a second side surface of the chassis integrally has a second shaft stop portion coming into contact with a second end surface of the shaft of the print head pressing member.

15 Claims, 17 Drawing Sheets

IMAGE GENERATING APPARATUS

BACKGROUND OF THE INVENTION

1. Field of the Invention

The present invention relates to an image generating apparatus.

2. Description of the Background Art

An image generating apparatus comprising various rotating shafts are known in general, as disclosed in each of Japanese Patent Laying-Open Nos. 2005-219310, 2004-114588, 2001-271826, 06-317975 (1994) and 08-225182 (1996), for example.

The aforementioned Japanese Patent Laying-Open No. 2005-219310 discloses a thermal transfer sheet cassette (ink sheet cartridge) comprising a columnar take-up core for taking up a thermal transfer sheet (ink sheet) and a take-up core holding portion. In the thermal transfer sheet cassette described in Japanese Patent Laying-Open No. 2005-219310, two cylindrical members are inserted into both ends of the take-up core, while a coil spring is set in the cylindrical member provided on one of the ends of the take-up core. The coil spring and the two cylindrical members keep the position of the take-up core.

The aforementioned Japanese Patent Laying-Open No. 2004-114588 discloses a thermal printer (image generating apparatus) comprising a thermal head for printing images on papers, a shaft (shaft portion) for rotatably mounting the thermal head on the printer body and a fixture for keeping the position of the shaft. In the thermal printer described in Japanese Patent Laying-Open No. 2004-114588, the shaft is inserted into axial holes provided on both ends of the thermal head respectively to pass through the same. At this time, the fixture is mounted from outside one of the axial holes of the thermal head to block up this axial hole, so that an end of the shaft passing through the axial holes comes into contact with the fixture. Thus, the fixture comes into contact with the shaft, thereby keeping the position of the shaft in the thermal head.

The aforementioned Japanese Patent Laying-Open No. 2001-271826 discloses an image generating apparatus comprising a paper feed support shaft including a paper feed roller for feeding recording sheets (printing papers) to the body of the apparatus and two bearing set portions including bearings for supporting the paper feed support shaft respectively. In the image generating apparatus described in Japanese Patent Laying-Open No. 2001-271826, the paper feed support shaft is inserted into holes provided in the bearings of the bearing set portions while two clasps are arranged on the paper feed support shaft to hold one of the bearings therebetween, thereby keeping the position of the paper feed support shaft on the bearing set portions.

The aforementioned Japanese Patent Laying-Open No. 06-317975 discloses an image generating apparatus comprising a roller shaft of metal, a slide bearing for rotatably supporting the roller shaft and a bearing slide guide pawl for holding the slide bearing. In the image generating apparatus described in Japanese Patent Laying-Open No. 06-317975, the slide bearing includes a hole for receiving the roller shaft, while the hole has a stopper for preventing the roller shaft from slipping off the hole. The bearing slide guide pawl formed on the body of the image generating apparatus holds the slide bearing, thereby fixing the same.

The aforementioned Japanese Patent Laying-Open No. 08-225182 discloses an image generating apparatus comprising a chassis so formed as to cover the body of the apparatus, a transport roller for transporting sheets (papers) to the body of the apparatus, two plastic bearings having holes and an L-shaped wire spring. In the image generating apparatus described in Japanese Patent Laying-Open No. 08-225182, the bearings are mounted by fitting both side ends of the transport roller into the holes of the bearings respectively, and thereafter fitting the portions of the bearings mounted on the transport roller into holes of the chassis. The center of the L-shaped wire spring is engaged with a groove provided in one of the bearings while both ends of the L-shaped wire spring are urged against the chassis respectively, thereby keeping the position of the transport roller on the chassis.

In the thermal transfer sheet cassette described in the aforementioned Japanese Patent Laying-Open No. 2005-219310, however, the coil spring and the two cylindrical members must be separately provided in order to keep the position of the take-up core, whereby the number of components is disadvantageously increased.

In the thermal printer described in the aforementioned Japanese Patent Laying-Open No. 2004-114588, the fixture must be separately provided in order to keep the position of the shaft, whereby the number of components is disadvantageously increased.

In the image generating apparatus described in the aforementioned Japanese Patent Laying-Open No. 2001-271826, the two clasps must be separately provided in order to keep the position of the paper feed support shaft, whereby the number of components is disadvantageously increased.

In the image generating apparatus described in the aforementioned Japanese Patent Laying-Open No. 06-317975, the slide bearing must be separated in order to support the roller shaft, whereby the number of components is disadvantageously increased.

In the image generating apparatus described in the aforementioned Japanese Patent Laying-Open No. 08-225182, the two bearings and the wire spring must be separately provided respectively in order to keep the position of the transport roller, whereby the number of components is disadvantageously increased.

SUMMARY OF THE INVENTION

The present invention has been proposed in order to solve the aforementioned problems, and an object of the present invention is to provide an image generating apparatus capable of keeping the position of a shaft without increasing the number of components.

An image generating apparatus according to a first aspect of the present invention comprises a chassis detachably mounted with an ink sheet cartridge storing an ink sheet and integrally provided with a first bearing, a print head rotatably mounted on the chassis, a print head pressing member, including a shaft held by the first bearing, pressing the print head, a cartridge stop member provided on a first side surface of the chassis for engaging with the ink sheet cartridge thereby preventing the ink sheet cartridge from slipping off the chassis and a side plate, provided on a second side surface of the chassis, integrally including at least a second bearing of a paper feed roller, while the cartridge stop member provided on the first side surface of the chassis integrally includes a first shaft stop portion coming into contact with a first end surface of the shaft of the print head pressing member, and the side plate provided on the second side surface of the chassis integrally includes a second shaft stop portion coming into contact with a second end surface of the shaft of the print head pressing member.

In the image generating apparatus according to the first aspect, as hereinabove described, the first bearing is integrally provided on the chassis while the cartridge stop member integrally including the first shaft stop portion is provided on the first side surface of the chassis and the side plate integrally including the second shaft stop portion is provided on the second side surface of the chassis so that the first and second shaft stop portions for holding the shaft of the print head pressing member are integrally included in the cartridge stop member and the side plate respectively and the first bearing is integrally provided on the chassis, whereby no member may be separately provided for holding the shaft of the print head pressing member on the chassis. Therefore, increase in the number of components can be suppressed. Further, both end surfaces of the shaft of the print head pressing member are brought into contact with the first shaft stop portion of the cartridge stop member and the second shaft stop portion of the side plate respectively and supported by the first bearing of the chassis, whereby the shaft of the print head printing member can be held without newly providing a separate member.

In the aforementioned image generating apparatus according to the first aspect, the second shaft stop portion preferably includes a shaft pressing portion elastically deformable in a first direction intersecting with the axis of the shaft and pressed in the first direction by a peripheral surface of the shaft close to a second end thereof when the shaft is mounted on the first bearing of the chassis. According to this structure, the shaft can be easily mounted on the first bearing of the chassis by pressing the elastically deformable shaft pressing portion of the second shaft stop portion with the peripheral surface of the shaft close to the second end thereof.

In the aforementioned image generating apparatus according to the first aspect, the second shaft stop portion is preferably provided with a contact portion, coming into contact with the second end surface of the shaft, on a position separated from a side surface of the shaft pressing portion closer to the shaft by a prescribed length outwardly from the shaft to be continuous with the shaft pressing portion. According to this structure, the second end surface of the shaft can be brought into contact with the contact portion, whereby the shaft can be inhibited from slipping off the body of the image generating apparatus. Therefore, the position of the shaft can be reliably kept.

In the aforementioned image generating apparatus according to the first aspect, the thickness of the contact portion in the first direction intersecting with the axis of the shaft is preferably larger than the corresponding thickness of the second shaft stop portion. According to this structure, the contact area between the contact portion and the second end surface of the shaft of the print head pressing portion can be so increased that the shaft can be reliably inhibited from slipping off the first bearing.

In the aforementioned image generating apparatus according to the first aspect, the second shaft stop portion is preferably so formed that the width in the axial direction of the shaft is larger than the thickness in the direction intersecting with the axis of the shaft. According to this structure, the second shaft stop portion can be inhibited from deformation in the axial direction of the shaft, whereby the shaft can be inhibited from slipping off the first bearing in the axial direction. Consequently, the shaft can be reliably held.

In the aforementioned image generating apparatus according to the first aspect, the first bearing preferably includes an L-shaped notch having a vertically extending first portion and a second portion horizontally extending from the first portion, for holding the shaft in the vicinity of the forward end of the second portion of the L-shaped notch. According to this structure, the horizontally provided second portion regulates vertical movement of the shaft, whereby the shaft can be reliably held.

The aforementioned image generating apparatus according to the first aspect preferably further comprises a platen roller opposed to the print head and a heat radiating member mounted on the print head for radiating heat generated in the print head, while the heat radiating member is preferably integrally provided with a push-up portion pushed up by the print head pressing member upon rotation of the print head pressing member, and the print head pressing member preferably so pushes up the push-up portion of the heat radiating member upon rotation of the print head pressing member as to move the heat radiating member and the print head in a direction for separating from the platen roller. According to this structure, the print head pressing member pushes up the push-up portion by the rotational force upon rotation thereof, whereby the heat radiating member and the print head can be easily rotated in the direction for separating from the platen roller with no requirement for a transmission mechanism so provided as to transmit the rotational force of the print head pressing member to the heat radiating member and the print head. Consequently, increase in the number of components can be further suppressed.

In this case, the print head pressing member preferably presses the print head toward the platen roller in printing, and the heat radiating member preferably includes a deviation preventing portion preventing the print head pressing member from deviating in the rotational direction when the print head pressing member presses the print head toward the platen roller in printing. According to this structure, the print head pressing member does not deviate in the rotational direction in printing, thereby reliably pressing the print head toward the platen roller.

In the aforementioned image generating apparatus according to the first aspect, the body of the print head pressing member is preferably made of resin. According to this structure, noise caused in the print head pressing member when sliding with the shaft of metal upon rotation can be suppressed as compared with a case where the print head pressing member is made of metal.

An image generating apparatus according to a second aspect of the present invention comprises a chassis detachably mounted with an ink sheet cartridge storing an ink sheet, a print head rotatably mounted on the chassis, a first bearing, integrally provided on the chassis, constituted of an L-shaped notch, a print head pressing member, including a shaft held by the first bearing, pressing the print head, a cartridge stop member provided on a first side surface of the chassis for engaging with the ink sheet cartridge thereby preventing the ink sheet cartridge from slipping off the chassis and a side plate, provided on a second side surface of the chassis, integrally including at least a second bearing of a paper feed roller, while the cartridge stop member provided on the first side surface of the chassis integrally includes a first shaft stop portion coming into contact with a first end surface of the shaft of the print head pressing member, the side plate provided on the second side surface of the chassis integrally includes a second shaft stop portion coming into contact with a second end surface of the shaft of the print head pressing member, the second shaft stop portion includes a shaft pressing portion elastically deformable in a first direction intersecting with the axis of the shaft and pressed in the first direction by a peripheral surface of the shaft close to a second end thereof when the shaft is mounted on the first bearing of the chassis, the second shaft stop portion of the side plate further includes a contact portion provided on a position separated from a side surface of the shaft pressing portion closer to the shaft by a prescribed length outwardly from the shaft to be continuous with the shaft pressing portion for coming into contact with the second end surface of the shaft, and the thickness of the contact portion of the second shaft stop portion in the first direction intersecting with the axis of the shaft is larger than the corresponding thickness of the second shaft stop portion.

In the image generating apparatus according to the second aspect, as hereinabove described, the first bearing is integrally provided on the chassis while the cartridge stop member integrally including the first shaft stop portion is provided on the first side surface of the chassis and the side plate integrally including the second shaft stop portion is provided on the second side surface of the chassis so that the first and second shaft stop portions for holding the shaft of the print head pressing member are integrally included in the cartridge stop member and the side plate respectively and the first bearing is integrally provided on the chassis, whereby no member may be separately provided for holding the shaft of the print head pressing member on the chassis. Therefore, increase in the number of components can be suppressed. Further, both end surfaces of the shaft of the print head pressing member are brought into contact with the first shaft stop portion of the cartridge stop member and the second shaft stop portion of the side plate respectively and supported by the first bearing of the chassis, whereby the shaft of the print head printing member can be held without newly providing a separate member.

In the image generating apparatus according to the second aspect, further, the second shaft stop portion includes the shaft pressing portion elastically deformable in the first direction intersecting with the axis of the shaft and pressed in the first direction by the peripheral surface of the shaft close to the second end thereof when the shaft is mounted on the first bearing of the chassis, whereby the shaft can be easily mounted on the first bearing of the chassis by pressing the elastically deformable shaft pressing portion of the second shaft stop portion with the peripheral surface of the shaft close to the second end thereof. In addition, the second shaft stop portion is provided with the contact portion, coming into contact with the second surface of the shaft, on the position separated from the side surface of the shaft pressing portion closer to the shaft by the prescribed length outwardly from the shaft to be continuous with the shaft pressing portion so that the second end surface of the shaft can be brought into contact with the contact portion, whereby the shaft can be inhibited from slipping off the body of the image generating apparatus. Therefore, the position of the shaft can be reliably kept. Further, the thickness of the contact portion in the first direction intersecting with the axis of the shaft is larger than the corresponding thickness of the second shaft stop portion, whereby the contact area between the contact portion and the second end surface of the shaft of the print head pressing portion can be so increased that the shaft can be reliably inhibited from slipping off the first bearing.

In the aforementioned image generating apparatus according to the second aspect, the second shaft stop portion is preferably so formed that the width in the axial direction of the shaft is larger than the width in the first direction intersecting with the axis of the shaft. According to this structure, the second shaft stop portion can be inhibited from deformation in the axial direction of the shaft, whereby the shaft can be inhibited from slipping off the first bearing in the axial direction. Consequently, the shaft can be reliably held.

In the aforementioned image generating apparatus according to the second aspect, the first bearing preferably includes the L-shaped notch having a vertically extending first portion and a second portion horizontally extending from the first portion, for holding the shaft in the vicinity of the forward end of the second portion of the L-shaped notch. According to this structure, the horizontally provided second portion regulates vertical movement of the shaft, whereby the shaft can be reliably held.

The aforementioned image generating apparatus according to the second aspect preferably further comprises a platen roller opposed to the print head and a heat radiating member mounted on the print head for radiating heat generated in the print head, while the heat radiating member is preferably integrally provided with a push-up portion pushed up by the print head pressing member upon rotation of the print head pressing member, and the print head pressing member preferably so pushes up the push-up portion of the heat radiating member upon rotation of the print head pressing member as to move the heat radiating member and the print head in a direction for separating from the platen roller. According to this structure, the print head pressing member pushes up the push-up portion by the rotational force upon rotation thereof, whereby the heat radiating member and the print head can be easily rotated in the direction for separating from the platen roller with no requirement for a transmission mechanism so provided as to transmit the rotational force of the print head pressing member to the heat radiating member and the print head. Consequently, increase in the number of components can be further suppressed.

In this case, the print head pressing member preferably presses the print head toward the platen roller in printing, and the heat radiating member preferably includes a deviation preventing portion preventing the print head pressing member from deviating in the rotational direction when the print head pressing member presses the print head toward the platen roller in printing. According to this structure, the print head pressing member does not deviate in the rotational direction in printing, thereby reliably pressing the print head toward the platen roller.

In the aforementioned image generating apparatus according to the second aspect, the body of the print head pressing member is preferably made of resin. According to this structure, noise caused in the print head pressing member when sliding with the shaft of metal upon rotation can be suppressed as compared with a case where the print head pressing member is made of metal.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Embodiments of the present invention are now described with reference to the drawings.

First Embodiment

First, the structure of a sublimatic printer 90 according to a first embodiment of the present invention is described with reference to FIGS. 1 to 22. According to the first embodiment, the present invention is applied to the sublimatic printer 90 employed as an exemplary image generating apparatus.

Figure 1:
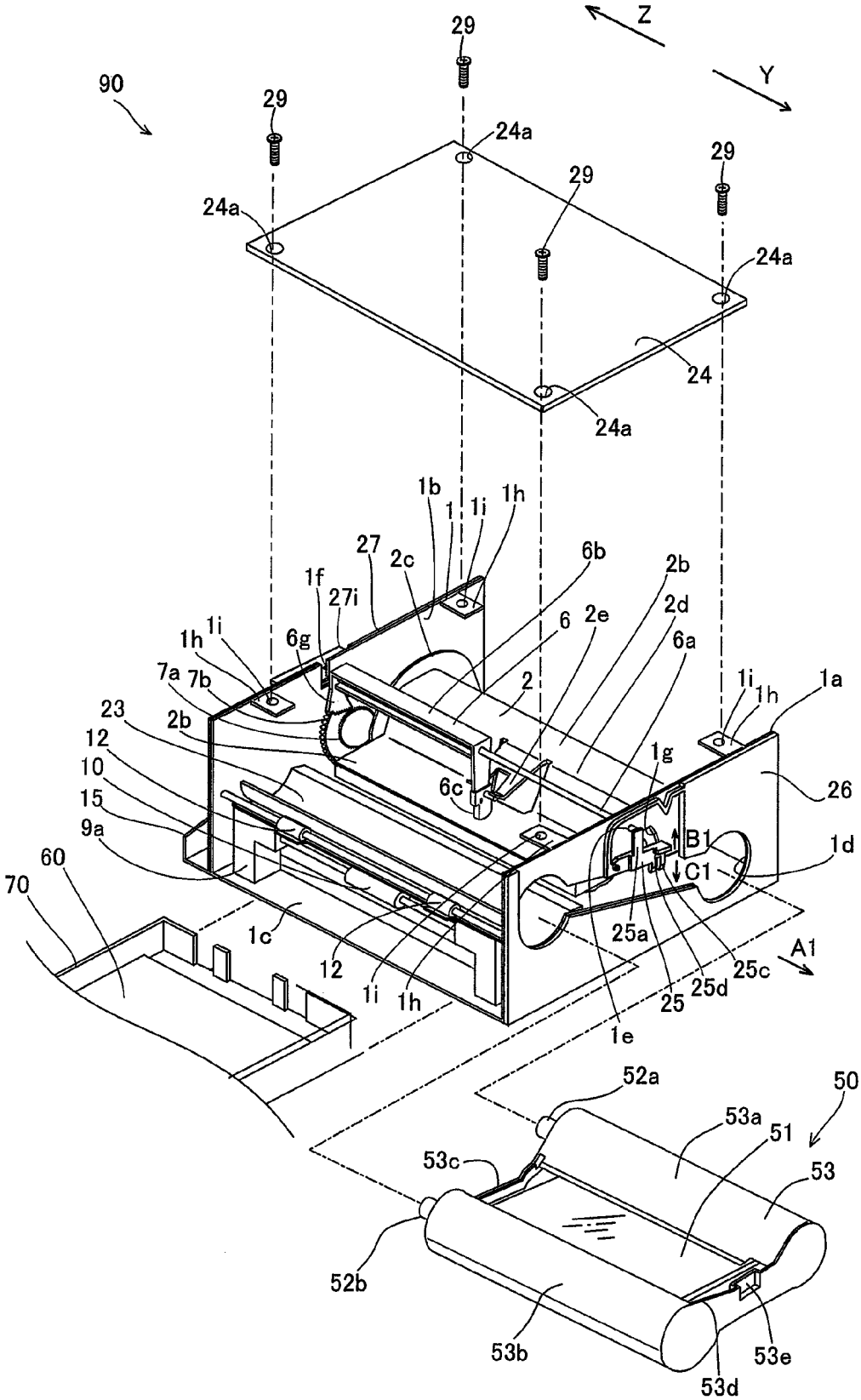
FIG. 1 is a perspective view showing the overall structure of a sublimatic printer according to a first embodiment of the present invention.
Figure 2:
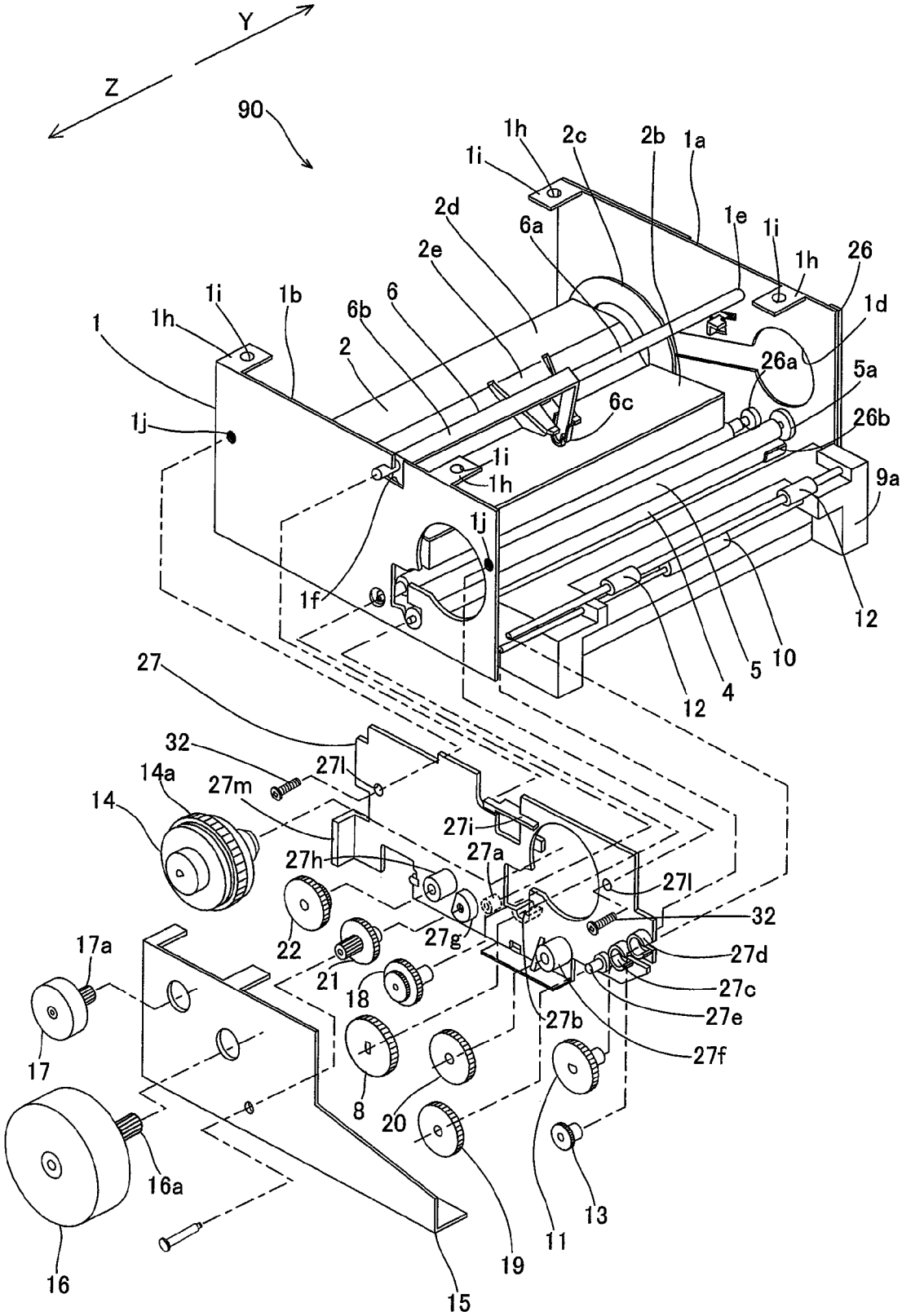
FIG. 2 is an exploded perspective view showing the overall structure of the sublimatic printer according to the first embodiment of the present invention shown in FIG. 1.

As shown in FIG. 1, the sublimatic printer 90 according to the first embodiment of the present invention comprises a chassis 1 of metal (sheet metal), a print head 2 for printing images, a platen roller 3 (see FIG. 5) opposed to the print head 2, a feed roller 4 (see FIG. 5) of metal, a press roller 5 (see FIG. 5) of metal pressing the feed roller 4 with prescribed pressing force, a print head pressing member 6, including a shaft 6*a*, pressing the print head 2, a driving gear 7 (see FIG. 4) of resin constituted of a small-diametral gear 7*a* and a large-diametral gear 7*b*, a feed roller gear 8 (see FIGS. 2 and 6), a lower paper guide 9*a* of resin, an upper paper guide 9*b* (see FIG. 5) of resin, a paper feed roller 10 of rubber, a paper feed roller gear 11 (see FIGS. 2 and 6), a paper discharge roller 12 of rubber, a paper discharge roller gear 13 (see FIGS. 2 and 6) and a take-up reel 14 (see FIG. 2).

The sublimatic printer 90 further comprises a motor bracket 15 (see FIG. 2) of sheet metal, a stepping motor 16 (see FIG. 2) for transporting papers 60, another stepping motor 17 (see FIG. 2) serving as the driving source for rotating the print head 2, a swingable swing gear 18 (see FIGS. 2 and 6), a plurality of intermediate gears 19 to 22 (see FIGS. 2 and 6), a cartridge support portion 23 supporting an ink sheet cartridge 50 storing an ink sheet 51, a top plate 24 and a housing 80 (see FIG. 3) storing the chassis 1 therein. The ink sheet cartridge 50 and a paper feed cassette case 70 for storing the papers 60 supplied to the sublimatic printer 90 are detachably mounted on the sublimatic printer 90 according to the first embodiment.

As shown in FIG. 1, the chassis 1 has a first side surface 1*a* and a second side surface 1*b* opposed to each other and a bottom surface 1*c*. The first side surface 1*a* of the chassis 1 is provided with a cartridge receiving hole 1*d* for receiving the ink sheet cartridge 50 and a support hole 1*e* (see FIG. 2) supporting a first end of the shaft 6*a* of the print head pressing member 6.

According to the first embodiment, the second side surface 1*b* of the chassis 1 is integrally provided with an L-shaped bearing if formed by notching the second side surface 1*b* in an L-shaped manner, in order to support a second end (along arrow Z in FIG. 2) of the shaft 6*a* of the print head pressing member 6, as shown in FIG. 2. The L-shaped bearing if is constituted of a vertical portion extending in the vertical direction (along arrow X1) and a horizontal portion extending in the horizontal direction (perpendicular to the direction along arrow X1). The L-shaped bearing 1*f* is an example of the "first bearing" in the present invention.

According to the first embodiment, a side plate 26 of resin integrally provided with a cartridge stop member 25 (see FIGS. 1 and 3) engaging with the ink sheet cartridge 50 thereby preventing the ink sheet cartridge 50 from slipping off the chassis 1 is mounted on the first side surface 1*a* of the chassis 1, as shown in FIG. 1. The side plate 26 is further integrally provided with a platen roller bearing 26*a* and a feed roller bearing 26*b* (see FIGS. 8 and 9) extending toward the inner side of the chassis 1 respectively, for supporting first ends (along arrow Y in FIG. 2) of the platen roller 3 and the feed roller 4 through holes (not shown) provided in the chassis 1 respectively, as shown in FIG. 2. Another side plate 27 of resin integrally including a platen roller bearing 27*a* supporting a second end (along arrow Z in FIG. 2) of the platen roller 3, a feed roller bearing 27*b* supporting the feed roller 4, a paper feed roller gear bearing 27*c* supporting the paper feed roller gear 11, a paper discharge roller gear bearing 27*d* supporting the paper discharge roller gear 13 and intermediate gear bearings 27*e* to 27*h* supporting the intermediate gears 19 to 22 respectively is mounted on the second side surface 1*b* of the chassis 1.

Figure 7:
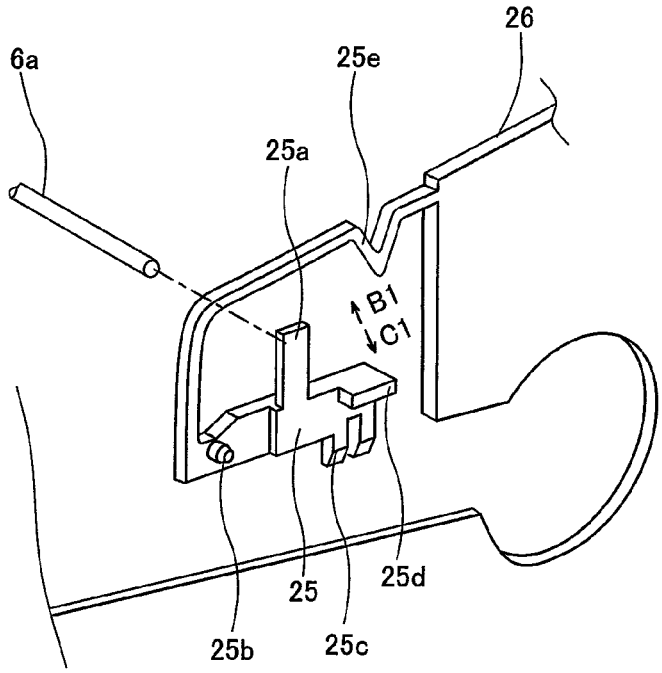
FIG. 7 is an enlarged perspective view showing a side plate mounted on a first side surface of the sublimatic printer according to the first embodiment of the present invention shown in FIG. 1.
Figure 8:
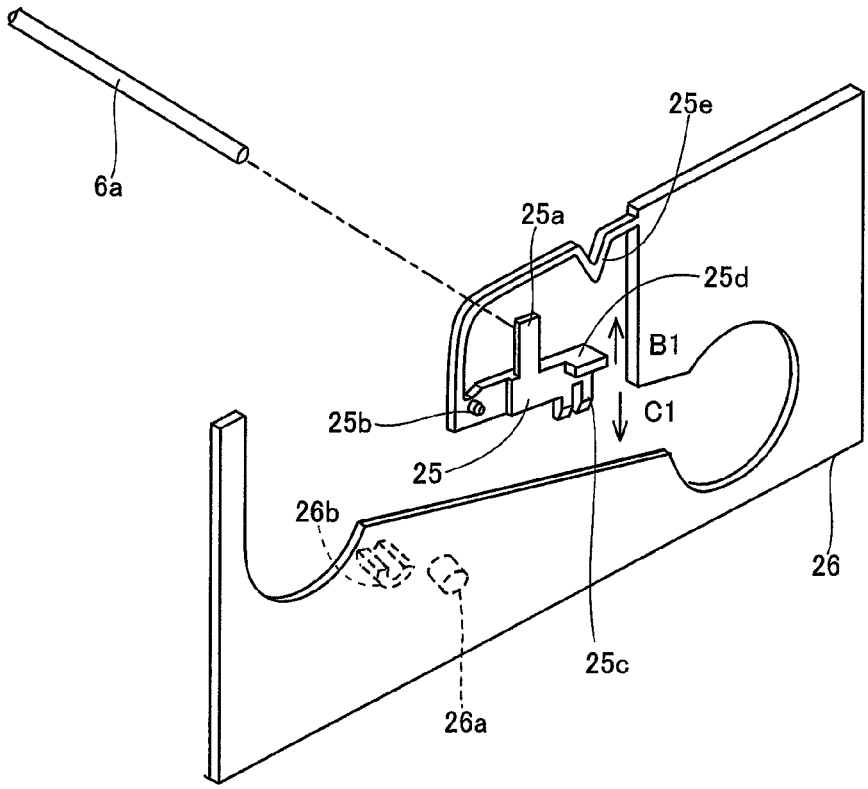
FIGS. 8 and 9 are entire perspective views of the side plate mounted on the first side surface of the sublimatic printer according to the first embodiment of the present invention shown in FIG. 1.
Figure 9:
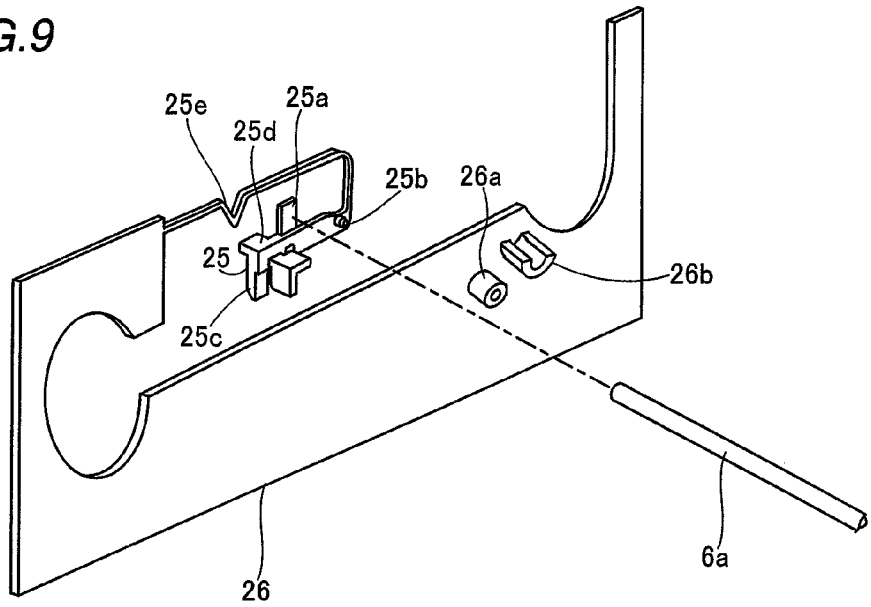

According to the first embodiment, the cartridge stop member 25 integrally provided on the side plate 26 mounted on the first side surface 1*a* of the chassis 1 integrally includes a first shaft stop portion 25*a* coming into contact with a first end surface of the shaft 6*a* of the print head pressing member 6, as shown in FIGS. 7 to 9.

Figure 10:
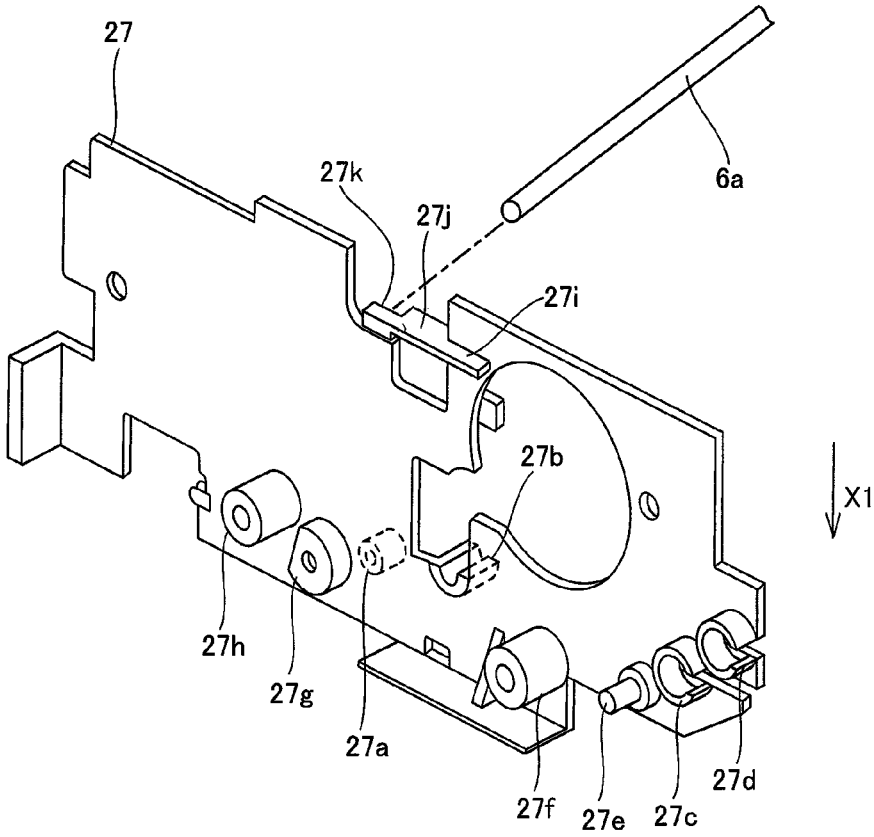
FIG. 10 is an entire perspective view showing another side plate mounted on a second side surface of the sublimatic printer according to the first embodiment of the present invention shown in FIG. 1.

According to the first embodiment, the side plate 27 integrally provided with the platen roller bearing 27*a* supporting the second end of the platen roller 3 and the like integrally includes a second shaft stop portion 27*i*, as shown in FIGS. 2 and 10.

Figure 11:
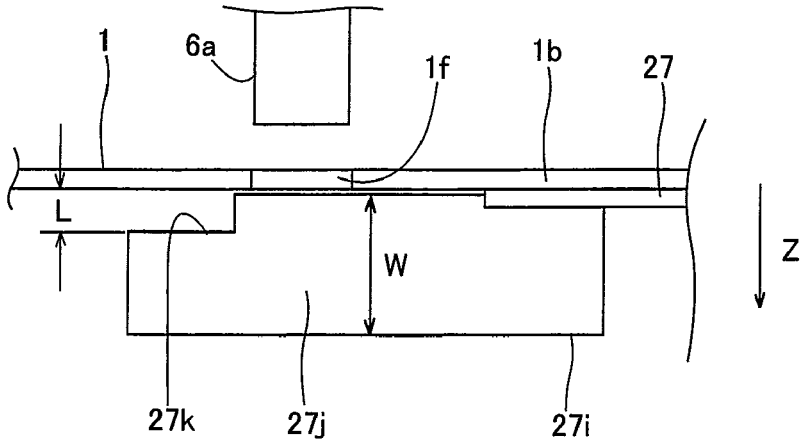
FIG. 11 is a plan view showing a second shaft stop portion provided on the side plate shown in FIG. 10.

According to the first embodiment, the second shaft stop portion 27*i* of the side plate 27 includes a shaft pressing portion 27*j* and a contact portion 27*k*, as shown in FIGS. 10 and 11. The shaft pressing portion 27*j* of the second shaft stop portion 27*i* is elastically deformable in a direction (along arrow X1 in FIG. 10) perpendicular to the shaft 6*a* of the print head pressing member 6, and pressed by a peripheral surface of the shaft 6*a* of the print head pressing member 6 close to the second end (along arrow Z in FIG. 2) thereof along arrow X1 when the shaft 6*a* is mounted on the L-shaped bearing 1*f* of the chassis 1. The contact portion 27*k* of the second shaft stop portion 27*i* is provided on a position separated from the side of the shaft pressing portion 27*j* closer to the shaft 6*a* of the print head pressing member 6 by a prescribed length (length L in FIG. 11) outward from the shaft 6*a* to be continuous with the shaft pressing portion 27*j* as shown in FIG. 11, to come into contact with a second end surface of the shaft 6*a*.

Figure 12:
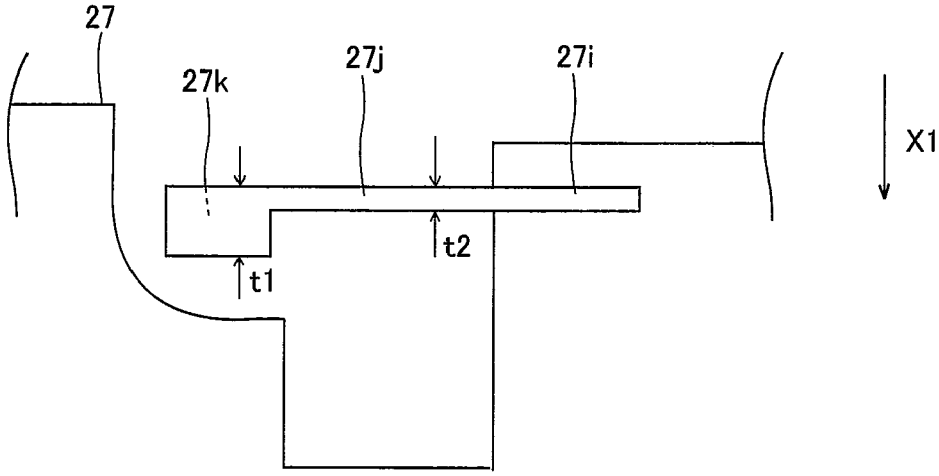
FIG. 12 is a side elevational view showing the second shaft stop portion provided on the side plate shown in FIG. 10.

According to the first embodiment, the thickness t1 of the contact portion 27*k* of the second shaft stop portion 27*i* in a direction (along arrow X1) intersecting with the axis of the shaft 6*a* of the print head pressing member 6 is larger than the corresponding thickness t2 of the second shaft stop portion 27*i*, as shown in FIG. 12. The second shaft stop portion 27*i* is so formed that the width W in the axial direction (along arrow Z) of the shaft 6*a* is larger than the thicknesses (t1 and t2 in FIG. 12) along arrow X1 as shown in FIG. 11, to be hardly elastically deformable in the axial direction (along arrow Z) of the shaft 6*a*.

Figure 13:
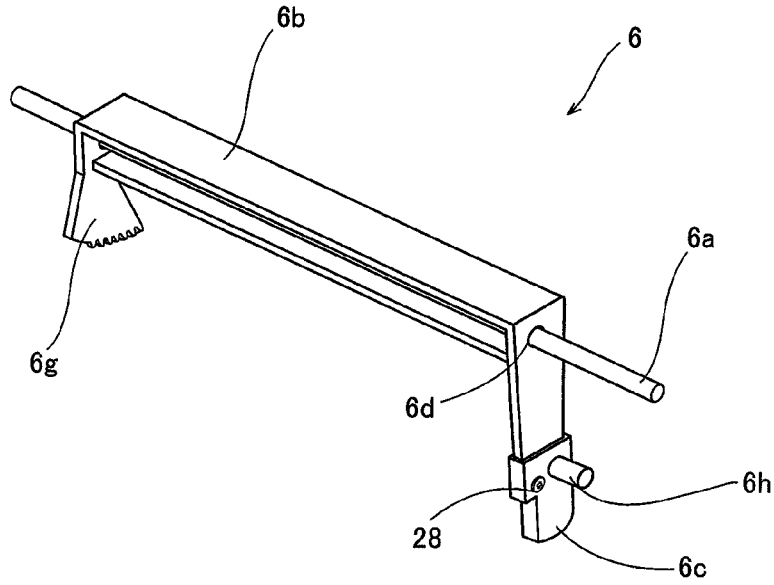
FIG. 13 is a perspective view of a print head pressing member mounted on the sublimatic printer according to the first embodiment of the present invention shown in FIG. 1.
Figure 14:
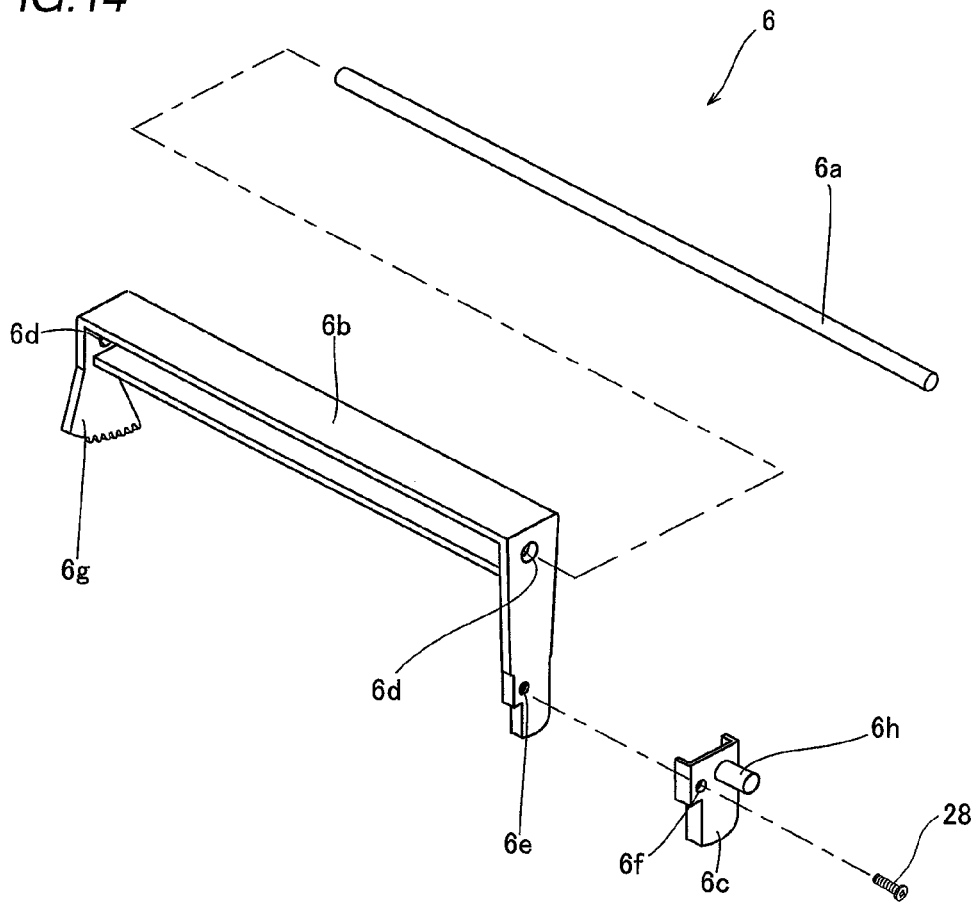
FIG. 14 is an exploded perspective view of the print head pressing member mounted on the sublimatic printer according to the first embodiment of the present invention shown in FIG. 1.

As shown in FIGS. 13 and 14, the print head pressing member 6 mounted on the chassis 1 is constituted of the shaft 6*a* of metal, a rotational portion 6*b* of metal and a pressing portion 6*c* of resin. The rotational portion 6*b* of metal is formed by performing sheet metal working on a plate member, and provided with receiving holes 6*d* for receiving the shaft 6*a* on both ends thereof respectively. A threaded hole 6*e* for mounting the pressing portion 6*c* with a screw 28 is provided on the side of the rotational portion 6*b* opposed to the first side surface 1*a* of the chassis 1. The pressing portion 6*c* is fixed to the rotational portion 6*b* by meshing the screw 28 with the threaded hole 6*e* of the rotational portion 6*b* through another threaded hole 6*f* of the pressing portion 6*c*. A gear portion 6*g* is provided on the side opposed to the second side surface 1*b* of the chassis 1. The pressing portion 6*c* is provided with a boss-shaped engaging portion 6*h* engaging with a notch 2*e* of the print head 2 described later in a projecting manner.

As shown in FIGS. 4 and 7 to 9, the cartridge stop member 25 integrally provided on the side plate 26 is provided with the aforementioned first shaft stop portion 25*a*, a support shaft 25*b* rotatably supporting the cartridge stop member 25, an engaging pawl 25*c* engaging with an engaging portion 53*e* (see FIGS. 1 and 3) of the ink sheet cartridge 50 described later, a grasp portion 25*d* employed by the user for lifting the cartridge stop member 25 upward (along arrow B1 in FIG. 7) with his/her finger and a spring portion 25*e* applying urging force for rotating the engaging pawl 25*c* of the cartridge stop member 25 downward (along arrow C1 in FIG. 7) when the user lifts up the grasp portion 25*d*. When the user lifts up the grasp portion 25*d* of the cartridge stop member 25, the cartridge stop member 25 slides upward along a hole 1*g* (see FIGS. 1 and 3) of the first side surface 1*a* of the chassis 1. When the cartridge stop member 25 slides upward, the cartridge stop member 25 is released from the state engaging with the ink sheet cartridge 50, so that the ink sheet cartridge 50 can be drawn out in a take-out direction (along arrow A1 in FIG. 1).

As shown in FIG. 1, two pairs of mounting portions 1*h* for mounting the top plate 24 are formed on the upper ends of the first and second side surfaces 1*a* and 1*b* of the chassis 1 respectively. The four mounting portions 1*h* of the chassis 1 are provided with threaded holes 1*i* for fixing the top plate 24 to the chassis 1 with screws 29 inserted into four holes 24*a* provided in the top plate 24 respectively. Paper sensors 30*a* and 30*b* for detecting front and rear ends of each paper 60 in printing are provided on the bottom surface 1*c* of the chassis 1, as shown in FIG. 5.

As shown in FIG. 2, the feed roller bearings 26*b* and 27*b* integrally provided on the side plates 26 and 27 respectively rotatably support the platen roller 3 and the feed roller 4. The feed roller bearing 26*b* of the side plate 26 supports the feed roller 4 through a hole (not shown) of the chassis 1, similarly to the platen roller bearing 26*a*. A press roller bearing 5*a* rotatably supports the press roller 5. The feed roller 4 and the press roller 5 rotate while holding each paper 60 therebetween, thereby transporting the paper 60 in a paper feed direction (along arrow T1) or a paper discharge direction (along arrow U1), as shown in FIG. 5. The paper feed roller 10 transports the papers 60 stored in the paper feed cassette case 70 (see FIG. 1) into the chassis 1.

Figure 5:
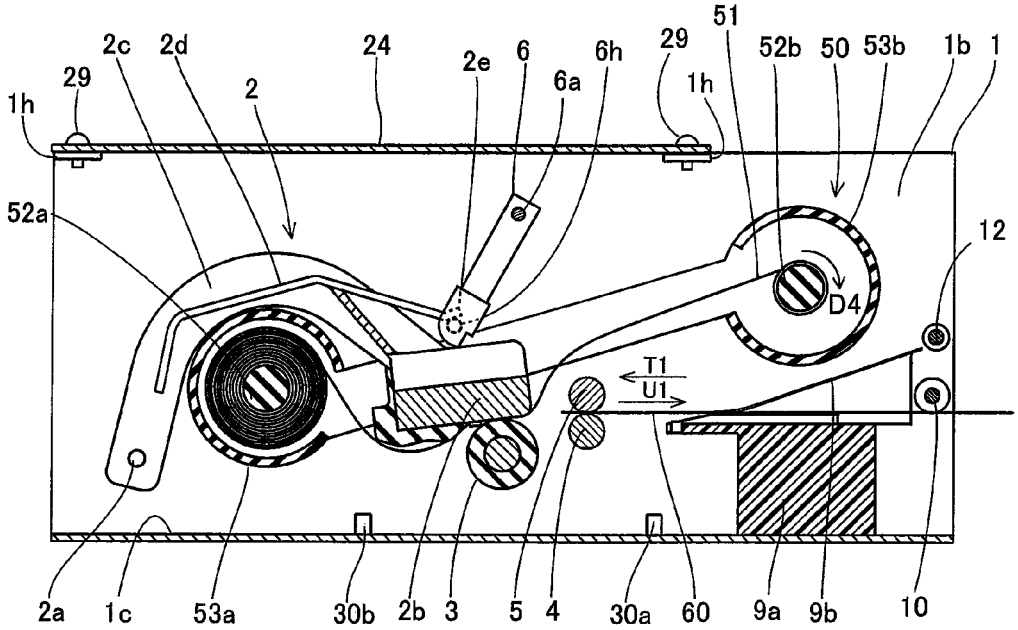
FIG. 5 is a sectional view of the sublimatic printer according to the first embodiment of the present invention shown in FIG. 1.

As shown in FIG. 5, the print head 2 includes a pair of support shafts 2*a*, a head portion 2*b* opposed to the platen roller 3 (see FIG. 2), a pair of arm portions 2*c* coupling the support shafts 2*a* and the head portion 2*b* with each other and a heat radiating member 2*d* of aluminum for radiating heat generated in the head portion 2*b*, and is vertically rotatable around the support shafts 2*a* mounted on the inner sides of the first and second side surfaces 1*a* and 1*b* of the chassis 1 respectively. The notch 2*e* engaging with the engaging portion 6*h* (see FIGS. 13 and 14) of the print head pressing member 6 is integrally formed on the central portion of the heat radiating member 2*d* by uprighting. When the print head pressing member 6 is rotated upward, therefore, the engaging portion 6*h* of the print head pressing member 6 and the notch 2*e* of the print head 2 engage with each other, whereby the head portion 2*b* is also rotated upward and the head portion 2*b* pressed by the platen roller 3 is separated from the platen roller 3.

Figure 4:
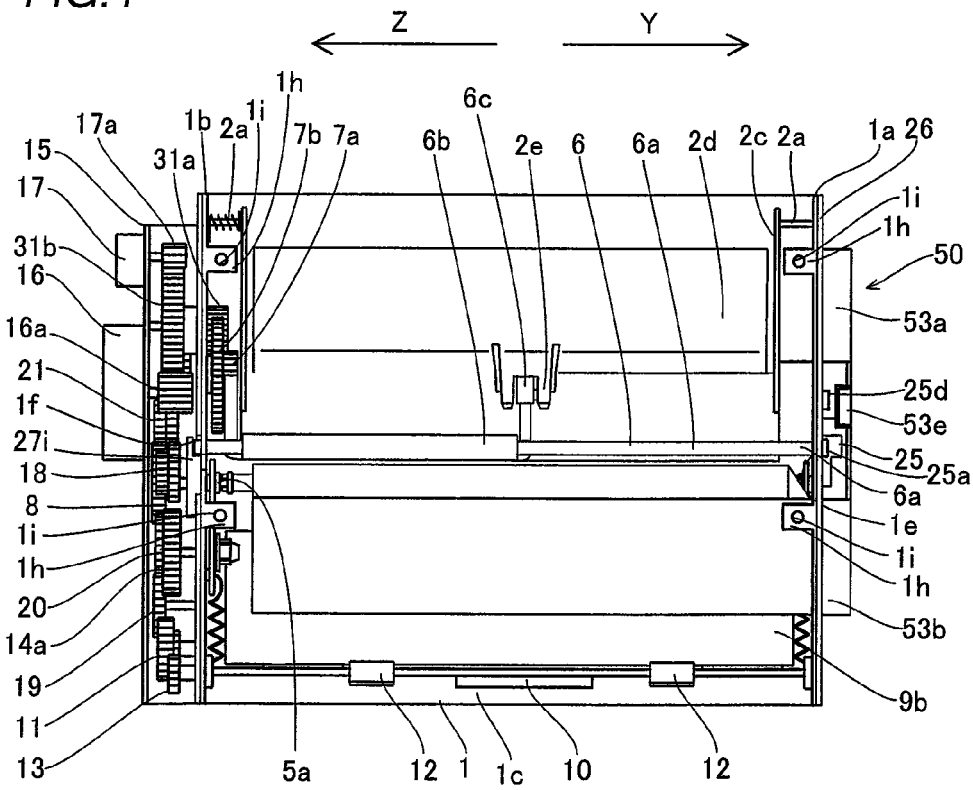
FIG. 4 is a plan view of the sublimatic printer according to the first embodiment of the present invention shown in FIG. 1.

As shown in FIGS. 2 and 4, the driving gear 7 constituted of the small-diametral gear 7*a* and the large-diametral gear 7*b* and the intermediate gear 31 constituted of a small-diametral gear 31*a* and a large-diametral gear 31*b* are so provided as to rotate the pressing portion 6*c* by transmitting the driving force of the stepping motor 17 to the pressing portion 6*c* of the print head pressing member 6. The driving gear 7 is mounted on the inner side of the second side surface 1*b* of the chassis 1. The intermediate gear 31 and the stepping motor 17 are mounted on the outer side of the second side surface 1*b* of the chassis 1 through the motor bracket 15. The small- and large-diametral portions 7*a* and 7*b* of the driving gear 7 mesh with the gear portion 6*g* (see FIGS. 13 and 14) of the print head pressing member 6 and the small-diametral gear 31*a* of the intermediate gear 31 respectively. The large-diametral gear portion 7*b* of the driving gear 7 meshes with a motor gear 17*a* of the stepping motor 17. Thus, the driving force of the stepping motor 17 is transmitted to the pressing portion 6*c* via the rotational portion 6*b* through the intermediate gear 31 and the driving gear 7.

As shown in FIG. 2, the side plate 27 is fixed by clamping two screws 32 into threaded holes 1*j* provided in the second side surface 1*b* of the chassis 1 through two holes 27*l* provided in the side plate 27, as shown in FIG. 2. The side plate 27 integrally includes a positioning portion 27*m* for positioning the motor bracket 15 mounted thereon.

Figure 6:
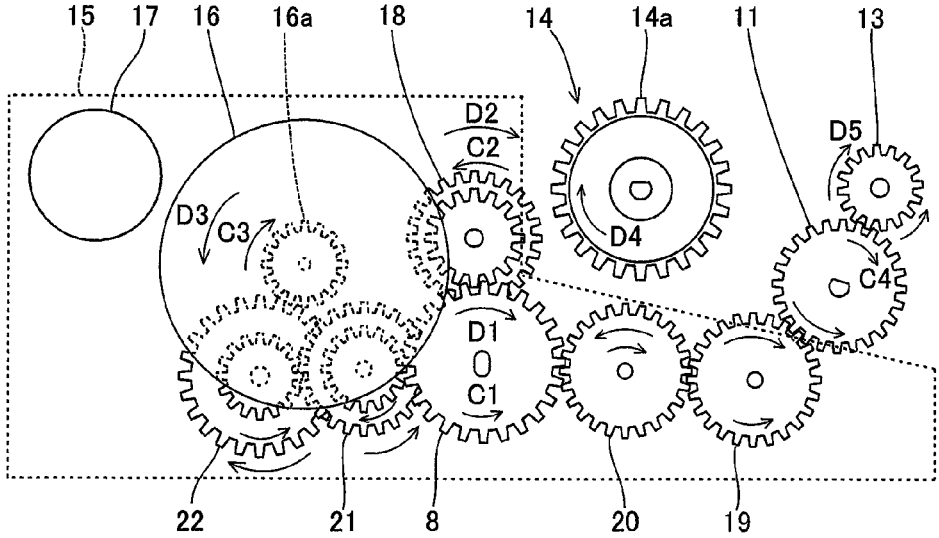
FIG. 6 illustrates the arrangement of gears in the sublimatic printer according to the first embodiment of the present invention shown in FIG. 1.

As shown in FIG. 2, a motor gear 16*a* is mounted on the shaft of the stepping motor 16 mounted on the motor bracket 15. The stepping motor 16 functions as a driving source for driving a gear portion 14*a* of the take-up reel 14, the paper feed roller gear 11, the paper discharge roller gear 13 and the feed roller gear 8, as shown in FIG. 6.

The take-up reel 14 engages with a take-up bobbin 52*b* (see FIG. 1) arranged in a take-up bobbin storage portion 53*b* of the ink sheet cartridge 50 described later, thereby taking up the ink sheet 51 wound on the take-up bobbin 52*b*. The gear portion 14*a* of the take-up reel 14 meshes with the swing gear 18 upon swinging thereof, as shown in FIG. 6.

The lower paper guide 9*a* is set in the vicinity of the feed roller 4 and the press roller 5, as shown in FIG. 5. The upper paper guide 9*b* is mounted on the upper portion of the lower paper guide 9*a*. The upper paper guide 9*b* has a function of guiding each paper 60 to a paper feed path to a printing portion through the lower surface thereof in paper feeding while guiding each paper 60 to a paper discharge path through the upper surface thereof in paper discharge.

Figure 3:
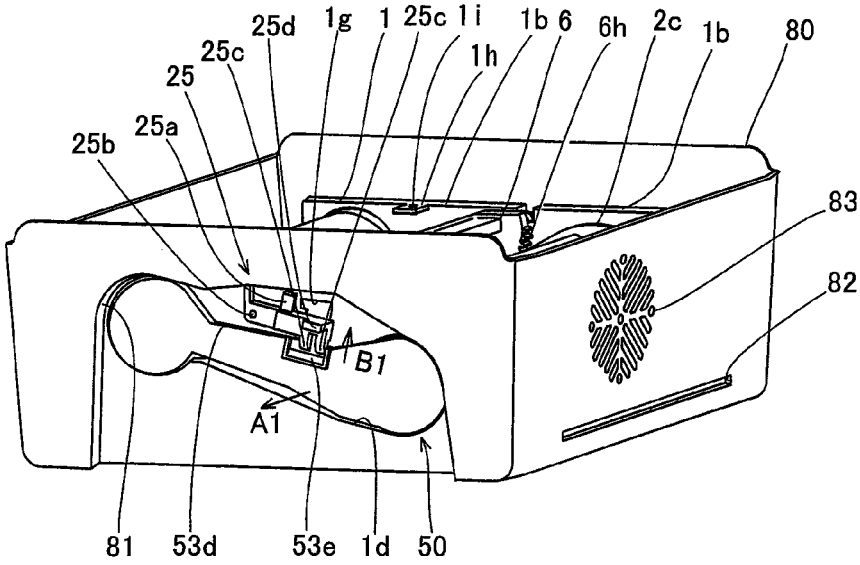
FIG. 3 is a perspective view of the sublimatic printer according to the first embodiment of the present invention shown in FIG. 1.

As shown in FIG. 3, the housing 80 includes a paper feed cassette receiving portion (not shown) receiving the paper feed cassette case 70 (see FIG. 1), a receiving hole 81 for receiving the ink sheet cartridge 50, a slot 82 passing each paper 60 therethrough in a reciprocative manner in printing and a heat discharge hole 83 for discharging heat generated in the print head 2 from the sublimatic printer 90.

As shown in FIG. 1, the ink sheet cartridge 50 includes a supply bobbin 52*a* for supplying the ink sheet 51 and the take-up bobbin 52*b* for taking up the supplied ink sheet 51. A cartridge case 53 constituting the ink sheet cartridge 50 is constituted of a supply bobbin storage portion 53*a* rotatably storing the supply bobbin 52*a*, the take-up bobbin storage portion 53*b* rotatably storing the take-up bobbin 52*b* and a pair of coupling portions 53*c* and 53*d* coupling the supply bobbin storage portion 53*a* and the take-up bobbin storage portion 53*b* with each other at a prescribed distance. When the supply bobbin storage portion 53*a* and the take-up bobbin storage portion 53*b* store the supply bobbin 52*a* and the take-up bobbin 52*b* respectively, therefore, the ink sheet 51 wound on the supply bobbin 52*a* and the take-up bobbin 52*b* is exposed on the space of the prescribed distance between the supply bobbin storage portion 53*a* and the take-up bobbin storage portion 53*b*. The coupling portion 53*d* is provided with the engaging portion 53*e* engaging with the cartridge stop member 25 (see FIGS. 1 and 3) of the side plate 26 provided on the first side surface 1*a* of the chassis 1. Helical compression springs (not shown) are provided in the supply bobbin storage portion 53*a* and the take-up bobbin storage portion 53*b* of the ink sheet cartridge 50 respectively. These helical compression springs regularly urge the ink sheet cartridge 50 mounted on the sublimatic printer 90 in the take-up direction (along arrow A1 in FIG. 1) for the ink sheet cartridge 50.

Figure 15:
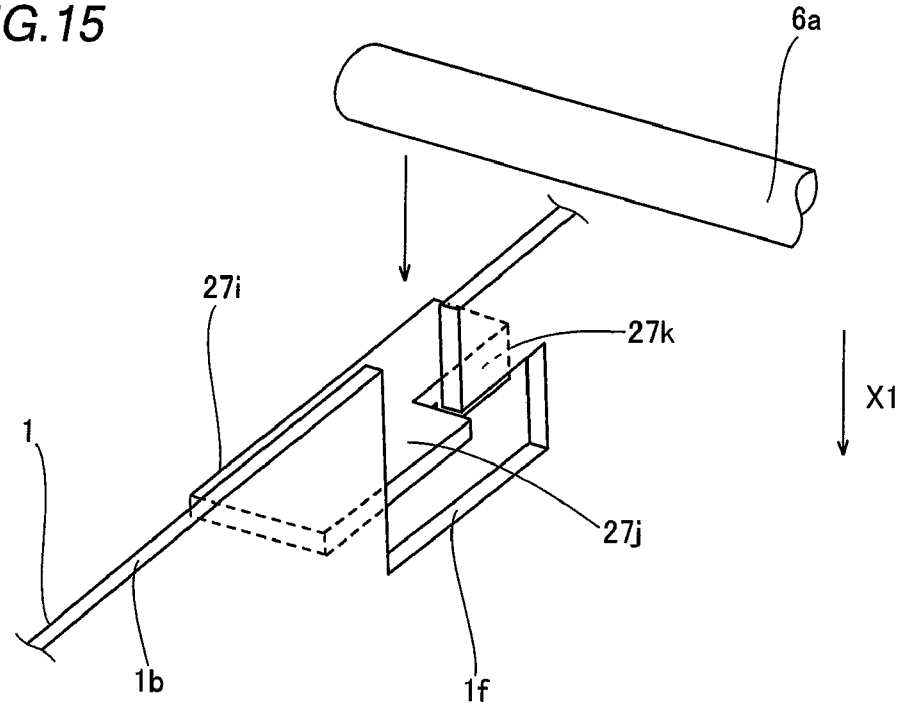
FIG. 15 is a perspective view for illustrating a method of mounting the print head pressing member on the sublimatic printer according to the first embodiment of the present invention shown in FIG. 1.
Figure 16:
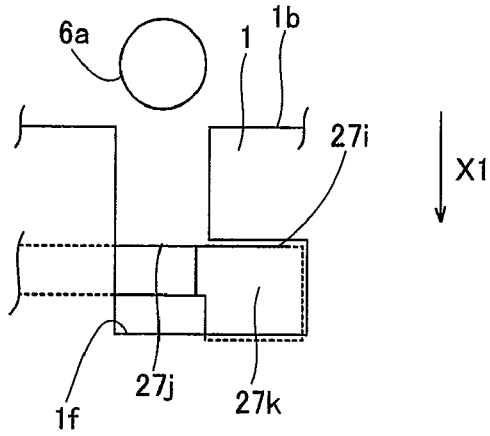
FIG. 16 is a sectional view for illustrating the method of mounting the print head pressing member on the sublimatic printer according to the first embodiment of the present invention shown in FIG. 1.
Figure 17:
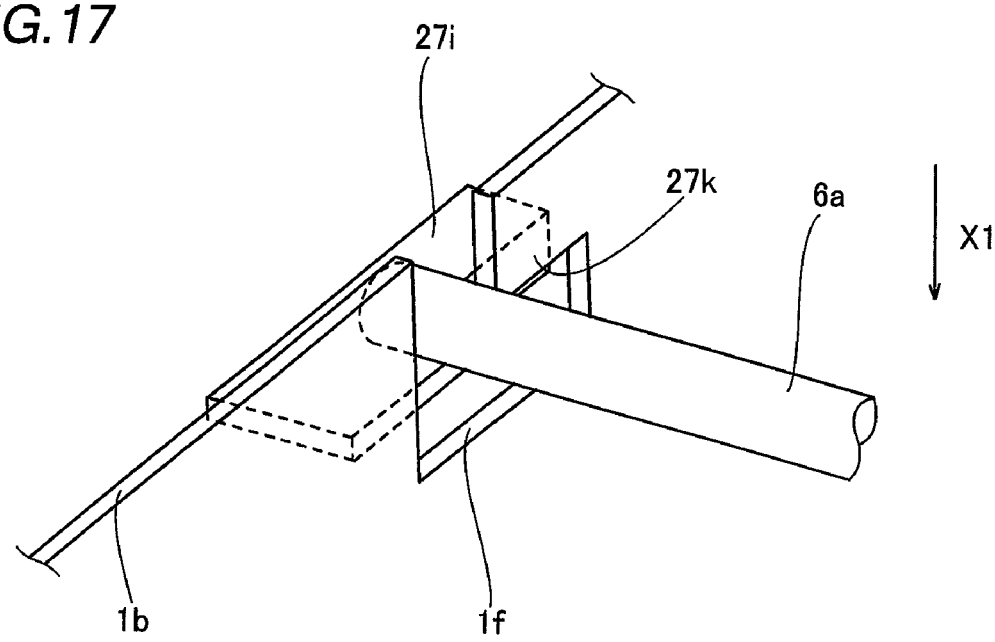
FIG. 17 is a perspective view for illustrating the method of mounting the print head pressing member on the sublimatic printer according to the first embodiment of the present invention shown in FIG. 1.
Figure 18:
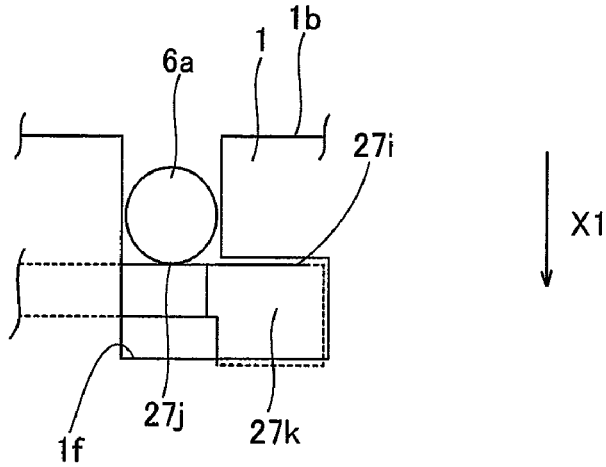
FIG. 18 is a sectional view for illustrating the method of mounting the print head pressing member on the sublimatic printer according to the first embodiment of the present invention shown in FIG. 1.
Figure 19:
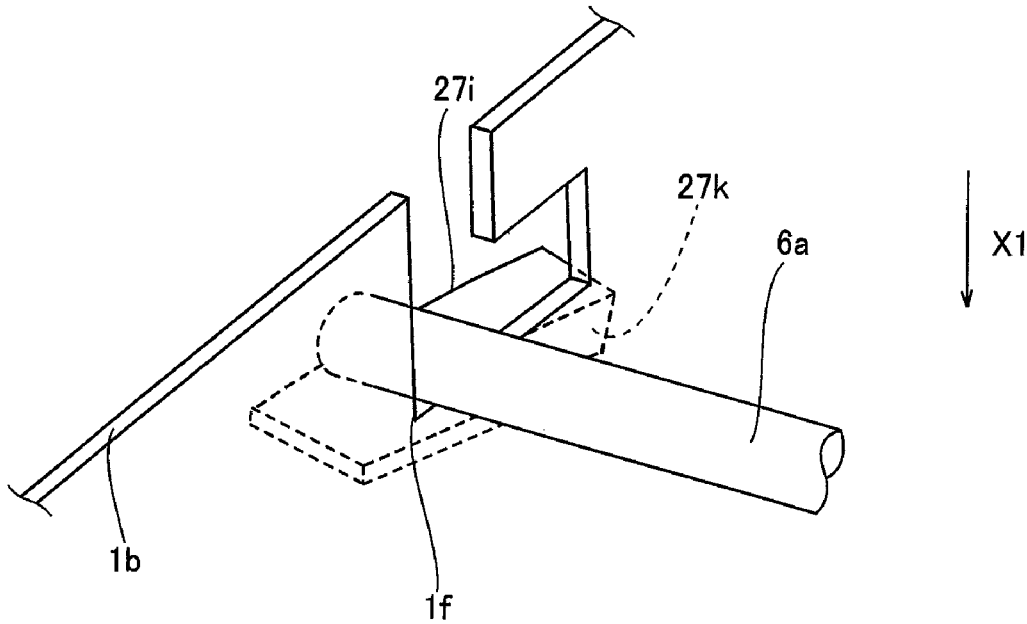
FIG. 19 is a perspective view for illustrating the method of mounting the print head pressing member on the sublimatic printer according to the first embodiment of the present invention shown in FIG. 1.
Figure 20:
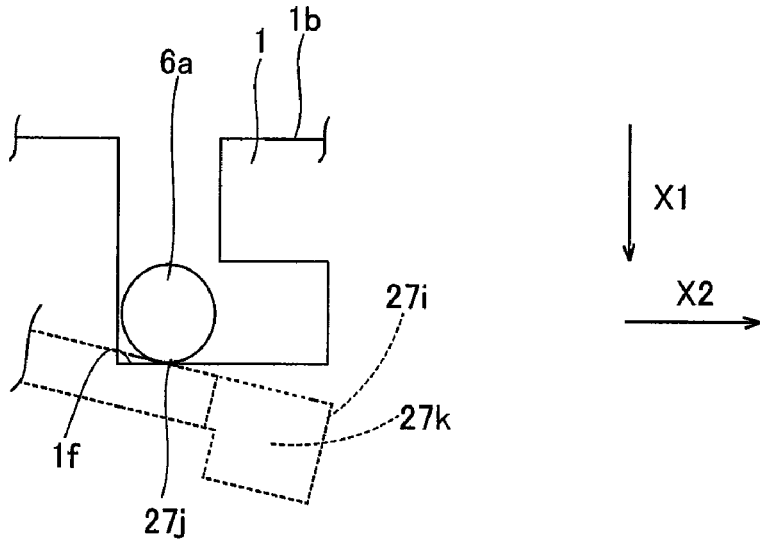
FIG. 20 is a sectional view for illustrating the method of mounting the print head pressing member on the sublimatic printer according to the first embodiment of the present invention shown in FIG. 1.
Figure 21:
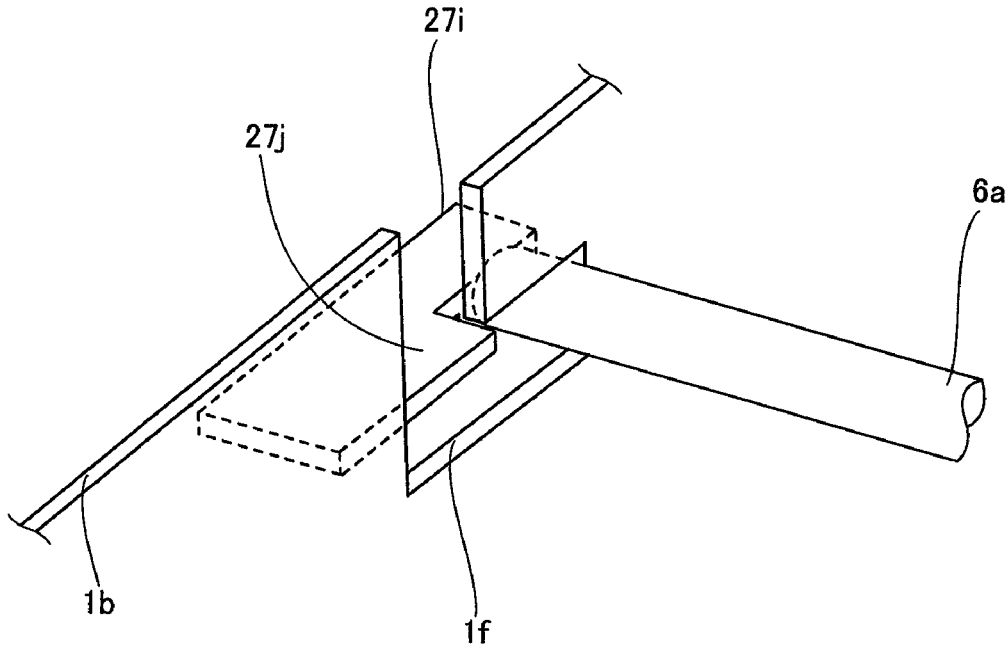
FIGS. 21 and 22 are perspective views for illustrating the method of mounting the print head pressing member on the sublimatic printer according to the first embodiment of the present invention shown in FIG. 1.
Figure 22:
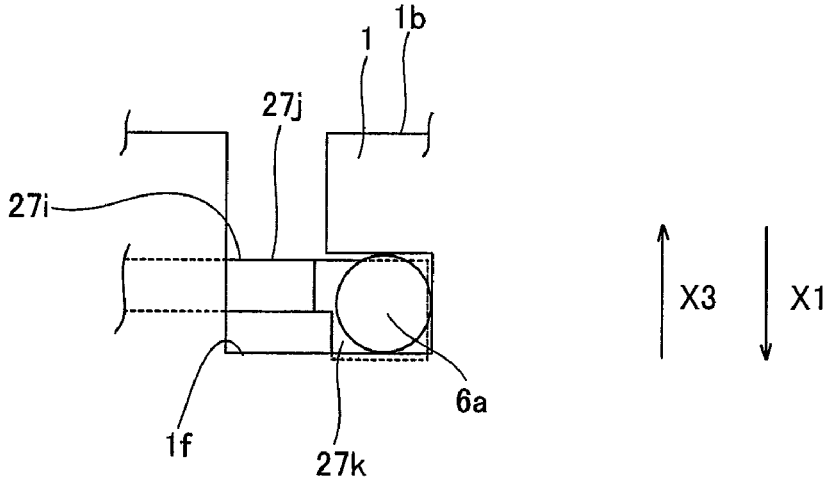

A method of mounting the print head pressing member 6 on the chassis 1 is now described. First, the first end (along arrow Y) of the shaft 6*a* of the print head pressing member 6 is inserted into the support hole 1*e* of the chassis 1, as shown in FIG. 2. At this time, the shaft 6*a* comes into contact with the first shaft stop portion 25*a* provided on the cartridge stop member 25 of the side plate 26 through the support hole 1*e* of the chassis 1 so that movement along arrow Y (see FIG. 4) is regulated, as shown in FIGS. 4 and 7 to 9. Therefore, the shaft 6*a* is inhibited from slipping off the chassis 1 along arrow Y. Then, the second end (along arrow Z in FIG. 2) of the shaft 6*a* is inserted along arrow X1 (vertical direction) with respect to the L-shaped bearing if of the chassis 1, as shown in FIGS. 15 and 16. At this time, the shaft 6*a* inserted along arrow X comes into contact with the shaft pressing portion 27*j* of the second shaft stop portion 27*i* provided on the side plate 27 without reaching the L-shaped bearing if, as shown in FIGS. 17 and 18. When the shaft 6*a* presses the shaft pressing portion 27*j* along arrow X1, the second shaft stop portion 27*i* is so deflected along arrow X1 that the shaft 6*a* reaches the bottom (horizontal portion) of the L-shaped bearing if, as shown in FIGS. 19 and 20. In this state, the shaft 6*a* so slides along arrow X2 as to reach a position (close to the forward end of the horizontal portion) of the L-shaped bearing if for holding the shaft 6*a* while the second shaft stop portion 27*i* is released from the pressing force of the shaft 6*a* along arrow X1, to be restored from the deflected state by restoring force along arrow X3, as shown in FIGS. 21 and 22. At this time, the second end (along arrow Z in FIG. 2) of the shaft 6*a* comes into contact with the contact portion 27*k* of the restored second shaft stop portion 27*i* so that movement along arrow Z (see FIG. 2) is regulated, as shown in FIG. 22. Thus, the shaft portion 6*a* is inhibited from slipping off the chassis 1 along arrow Z (see FIG. 2). Thus, the shaft 6*a* is supported by the support hole 1*e* and the L-shaped bearing 1*f* (see FIG. 1) of the chassis 1 and inhibited from slipping off the chassis 1 and the side plates 26 and 27 by the first shaft stop portion 25*a* and the contact portion 27*k* (see FIGS. 9 and 10) of the second shaft stop portion 27*i*, to be kept at the proper position.

A printing operation of the sublimatic printer 90 according to the first embodiment of the present invention is now described with reference to FIGS. 6 and 20.

First, the stepping motor 16 is so driven as to rotate the motor gear 16*a* mounted thereon along arrow C3 and to rotate the feed roller gear 8 along arrow C1 through the intermediate gears 21 and 22, as shown in FIG. 6. Thus, the feed roller 4 is rotated along arrow C1 in FIG. 6. Further, the paper feed roller gear 11 and the paper feed roller 10 are rotated along arrow C4 in FIG. 23 through the intermediate gears 19 and 20. Thus, each paper 60 is transported in the paper feed direction (along arrow T1 in FIG. 23). At this time, the swingable swing gear 18 and the gear portion 14*a* of the take-up reel 14 are out of mesh, and the gear portion 14*a* of the take-up reel 14 remains unrotated. Thus, the ink sheet 51 wound on the supply bobbin 52*a* and the take-up bobbin 52*b* is not taken up in paper feeding.

Figure 23:
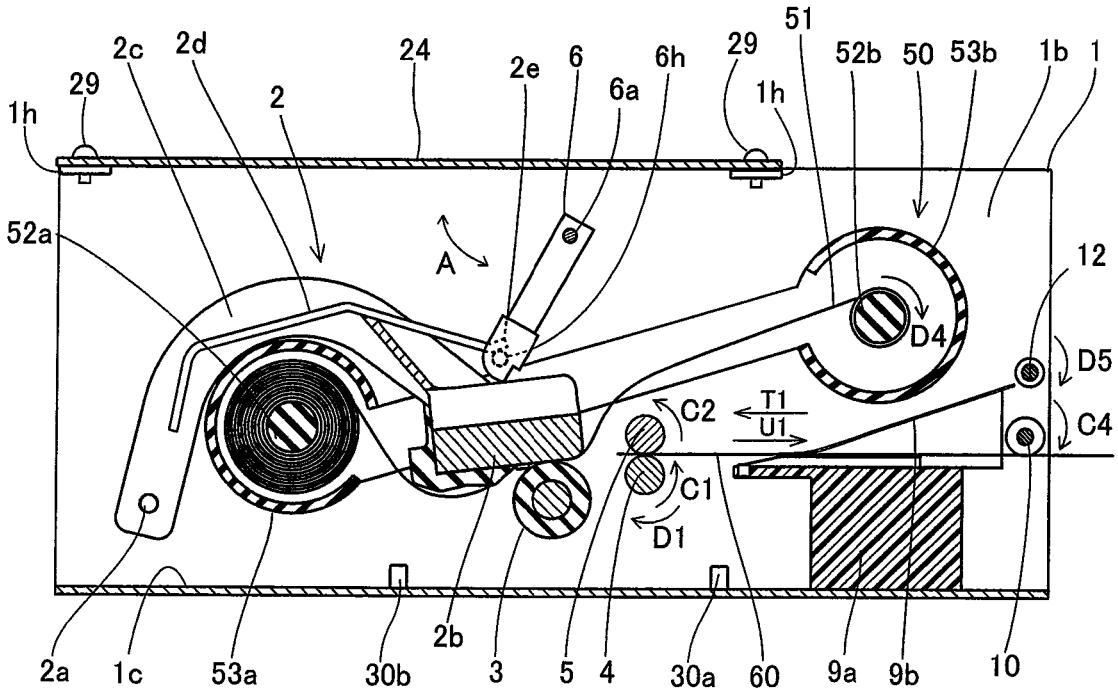
FIG. 23 is a diagram for illustrating an operation of the sublimatic printer according to the first embodiment of the present invention shown in FIG. 1.

As shown in FIG. 23, the paper sensors 30*a* and 30*b* detect the front and rear ends of the paper 60 respectively, thereby determining whether or not the paper 60 has been transported to a printing start position. When the paper 60 reaches the printing start position, the print head 2 lowers to the printing position and starts printing.

As shown in FIG. 23, further, the stepping motor 16 (see FIG. 6) is so driven as to rotate the motor gear 16*a* mounted thereon along arrow D3 in FIG. 6 and to rotate the feed roller gear 8 along arrow D1 in FIG. 6 through the intermediate gears 21 and 22. Thus, the feed roller 4 is rotated along arrow D1 in FIG. 23, and the press roller 5 is rotated along arrow B in FIG. 23 following the rotation of the feed roller 4. Further, the paper discharge roller gear 13 and the paper discharge roller 12 are rotated along arrow D5 in FIGS. 6 and 23 through the intermediate gears 19 and 20 and the paper feed roller 10. Thus, the paper 60 is transported in the paper discharge direction (along arrow U1 in FIG. 23) corresponding to the printing direction. At this time, the swingable swing gear 18 (see FIG. 6) meshes with the gear portion 14*a* of the take-up reel 14, so that the ink sheet 51 wound on the supply bobbin 52*a* and the take-up bobbin 52*b* engaging with the take-up reel 14 is taken up on the take-up bobbin 52*b*.

After the paper 60 is printed, the printed paper 60 is discharged. At this time, the printed paper 60 is transported along arrow U1 in FIG. 23, similarly to the operation for printing images on the paper 60. The printed paper 60 is transported on the upper side of the upper paper guide 9*b*, and discharged by the paper discharge roller 12 rotated along arrow D5 in FIG. 23.

According to the first embodiment, as hereinabove described, the chassis 1 is integrally provided with the first bearing if while the cartridge stop member 25 integrally including the first shaft stop portion 25*a* is provided on the first side surface 1*a* of the chassis 1 and the side plate 27 integrally including the second shaft stop portion 27*i* is provided on the second side surface 1*b* of the chassis 1 so that the first and second shaft stop portions 25*a* and 27*i* for holding the shaft 6*a* of the print head pressing member 6 are integrally included in the cartridge stop member 25 and the side plate 27 respectively and the first bearing 1*f* is integrally provided on the chassis 1, whereby no member may be separately provided for holding the shaft 6*a* of the print head pressing member 6 on the chassis 1. Therefore, increase in the number of components can be suppressed. Further, both end surfaces of the shaft 6*a* of the print head pressing member 6 are brought into contact with the first and second shaft stop portions 25*a* and 27*i* of the cartridge stop member 25 and the side plate 27 respectively and supported by the first bearing 1*f* of the chassis 1, whereby the shaft 6*a* of the print head pressing member 6 can be held without newly providing a separate member.

According to the first embodiment, the second shaft stop portion 27*i* includes the shaft pressing portion 27*j* elastically deformable along arrow X1 (see FIG. 12) perpendicularly to the axis of the shaft 6*a* and pressed by the peripheral surface of the shaft 6*a* close to the second end (along arrow Z in FIG. 1) thereof along arrow X1 (see FIG. 12) when the shaft 6*a* is mounted on the L-shaped bearing if of the chassis 1, whereby the shaft 6*a* can be easily mounted on the L-shaped bearing if of the chassis 1 by pressing the elastically deformable shaft pressing portion 27*j* of the second shaft stop portion 27*i* with the peripheral surface of the shaft 6*a* close to the second end (along arrow Z in FIG. 1) thereof.

According to the first embodiment, the second shaft stop portion 27*i* is provided with the contact portion 27*k* coming into contact with the second end surface (along arrow Z) of the shaft 6*a* on the position separated from the side surface of the shaft pressing portion 27*j* closer to the shaft 6*a* by the length L (see FIG. 11) outward from the shaft 6*a* to be continuous with the shaft pressing portion 27*j* so that the second end surface (along arrow Z in FIG. 1) of the shaft 6*a* can be brought into contact with the contact portion 27*k*, whereby the shaft 6*a* can be inhibited from slipping off the chassis 1. Therefore, the position of the shaft 6*a* can be reliably kept.

According to the first embodiment, the thickness of the contact portion 27*k* along arrow X1 (see FIG. 12) perpendicular to the axis of the shaft 6*a* is larger than the corresponding thickness of the second shaft stop portion 27*i* so that the contact area between the contact portion 27*k* and the second end surface (along arrow Z in FIG. 1) of the shaft 6*a* of the print head pressing member 6 can be increased, whereby the shaft 6*a* can be reliably inhibited from slipping off the chassis 1.

According to the first embodiment, the width W of the second shaft stop portion 27*i* in the axial direction (along arrow Z) of the shaft 6*a* is larger than the thicknesses (t1 and t2 in FIG. 12) along arrow X1 so that the second shaft stop portion 27*i* can be inhibited from deformation in the axial direction of the shaft 6*a*, whereby the shaft 6*a* can be inhibited from slipping off the chassis 1 in the axial direction, and can be reliably held as a result.

Second Embodiment

The structure of a sublimatic printer 100 according to a second embodiment of the present invention is described with reference to FIGS. 24 to 29. In the sublimatic printer 100 according to the second embodiment, a rotational portion 102 of a print head pressing member 101 is made of not metal but resin, dissimilarly to the sublimatic printer 90 according to the aforementioned first embodiment.

Figure 24:
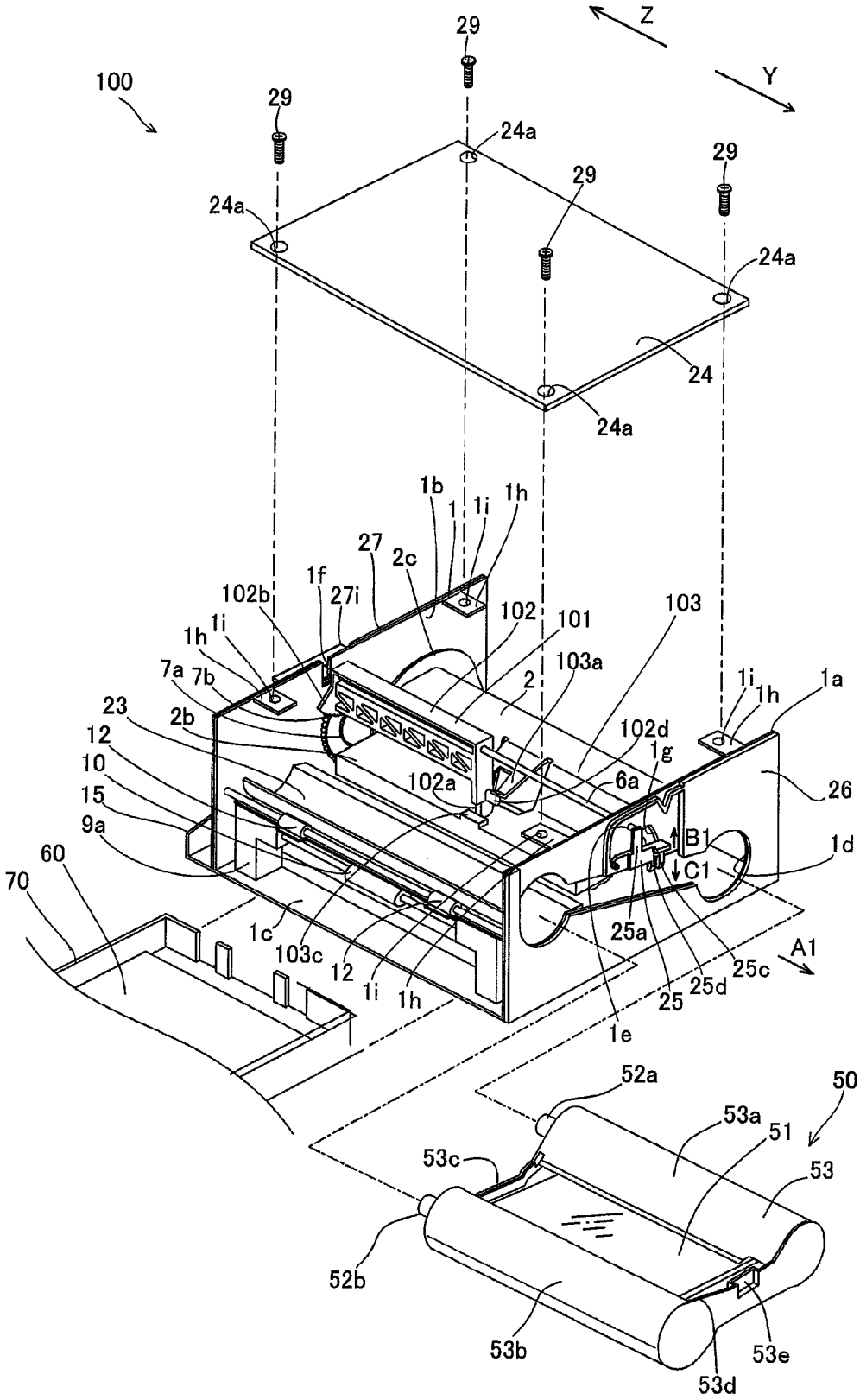
FIG. 24 is a perspective view showing the overall structure of a sublimatic printer according to a second embodiment of the present invention.

The sublimatic printer 100 according to the second embodiment comprises the print head pressing member 101, including a shaft 6*a*, pressing a print head 2, as shown in FIG. 24.

The print head 2 includes a heat radiating member 103 for radiating heat from a head portion 2*b*, as shown in FIG. 24.

Figure 25:
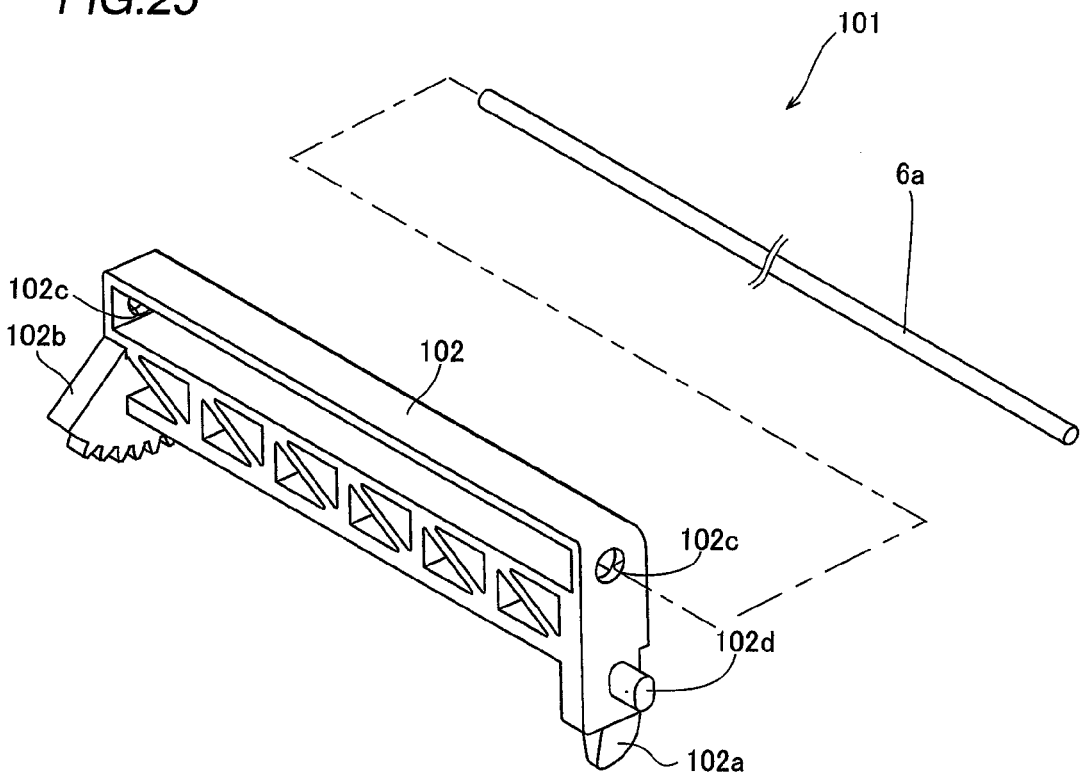
FIGS. 25 and 26 are perspective views for illustrating a print head pressing member of the sublimatic printer according to the second embodiment of the present invention shown in FIG. 24.
Figure 26:
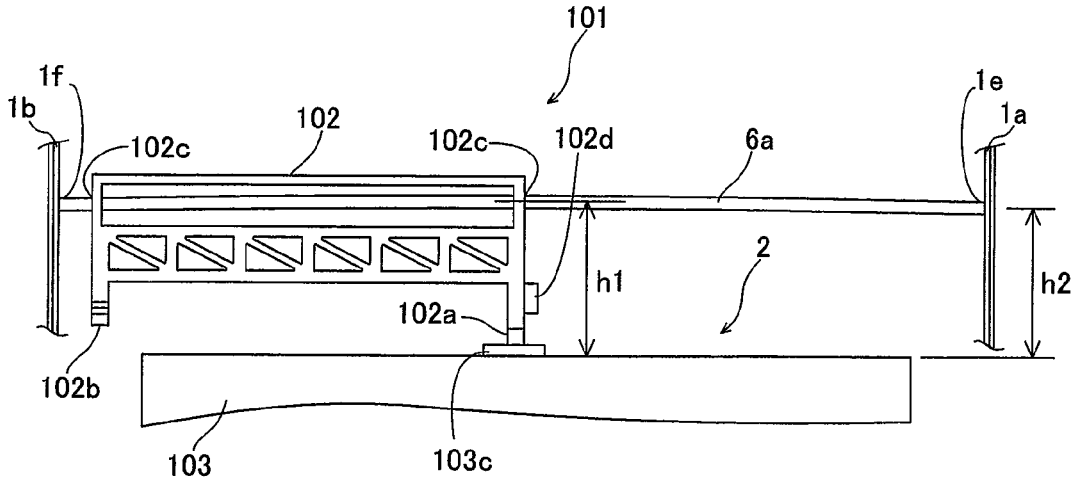

According to the second embodiment, the print head pressing member 101 is constituted of the shaft 6*a* of metal and the rotational portion 102 of resin, as shown in FIGS. 24 and 25. A pressing portion 102*a* and a sectorial gear portion 102*b* are integrally provided on longitudinal ends of the rotational portion 102 respectively. The print head pressing member 101 is so arranged above the print head 2 that the pressing portion 102*a* presses a substantially central portion of the print head 2 in the cross direction (along arrows Y and Z). Receiving holes 102*c* for receiving the shaft 6*a* are provided on both ends of the rotational portion 102 of resin respectively. The rotational portion 102 is rotatable around the shaft 6*a* received in the receiving holes 102*c*. As shown in FIG. 26, the receiving holes 102*c* are so formed that the distance h1 between the upper surface of the print head 2 and the receiving holes 102*c* is larger than the distance h2 between the upper surface of the print head 2 and support holes 1*e* and if for the shaft 6*a* provided on first and second side surfaces 1*a* and 1*b* of a chassis 1 respectively when the pressing portion 102*a* is in contact with the upper surface of the print head 2 in printing. Thus, the shaft 6*a* is so deflected as to protrude the axial center thereof upward when the pressing portion 102*a* is in contact with the upper surface of the print head 2 in printing, thereby pressing the print head 2 downward from above with downward restoring force of the shaft 6*a* through the pressing portion 102*a*. Consequently, the print head 2 is pressed toward the platen roller 3 in printing.

Figure 27:
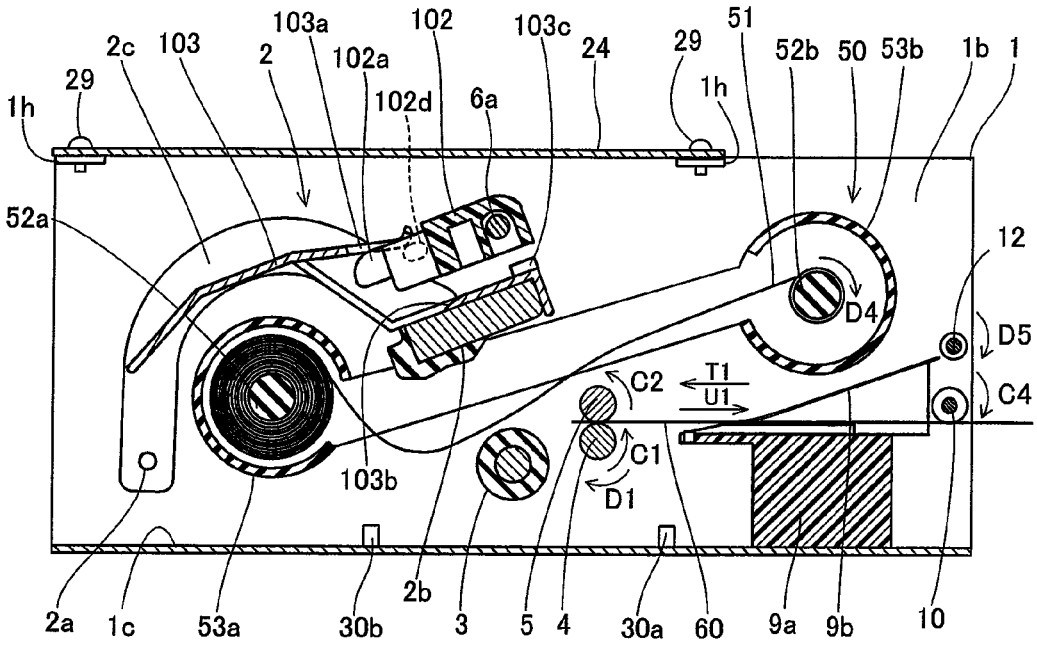
FIGS. 27 to 29 are sectional views of the sublimatic printer according to the second embodiment of the present invention shown in FIG. 24.

According to the second embodiment, a push-up portion 103*a* pushed up by a protrusion 102*d* provided on the rotational portion 102 upon upward rotation of the rotational portion 102 is integrally formed at the center of the heat radiating member 103 by uprighting. Thus, the push-up portion 103*a* of the heat radiating member 103 is pushed up by the protrusion 102*d* of the rotational portion 102 upon upward rotation of the rotational portion 102 thereby rotating the print head 2 in a direction for separating from the platen roller 3, as shown in FIG. 27.

Figure 28:
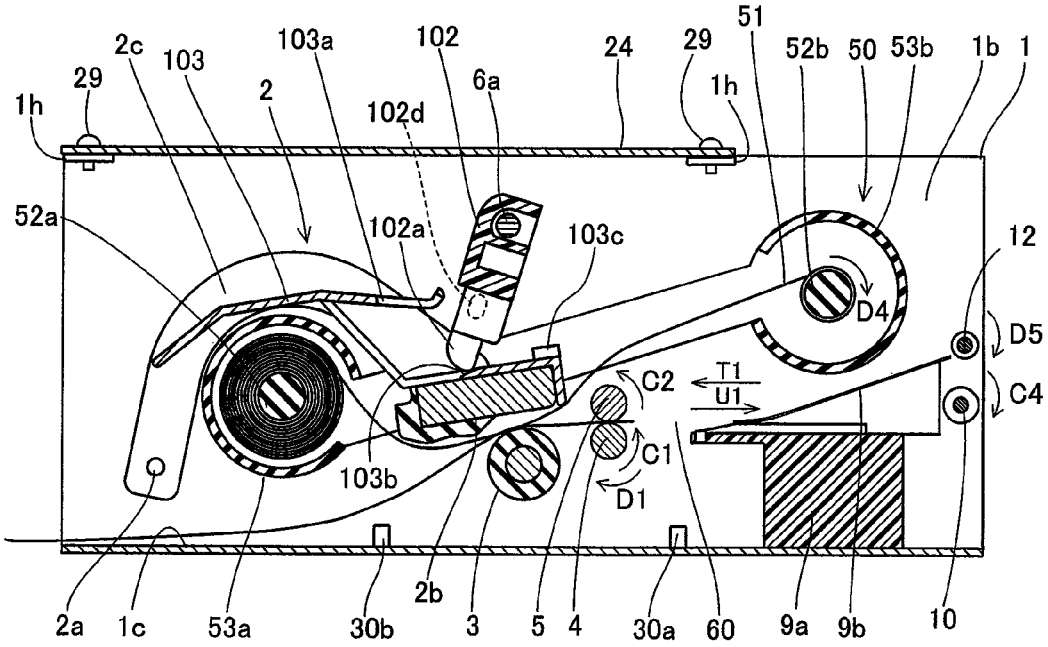

An edge 103*b* of an opening resulting from the uprighting for forming the push-up portion 103*a* is smoothly inclined in the vertical direction. Thus, the pressing portion 102*a* of the rotational portion 102 smoothly slides along the edge 103*b* upon downward rotation of the rotational portion 102 as shown in FIGS. 28 and 29, whereby the pressing portion 102*a* can easily move to the upper surface of the heat radiating member 103.

Figure 29:
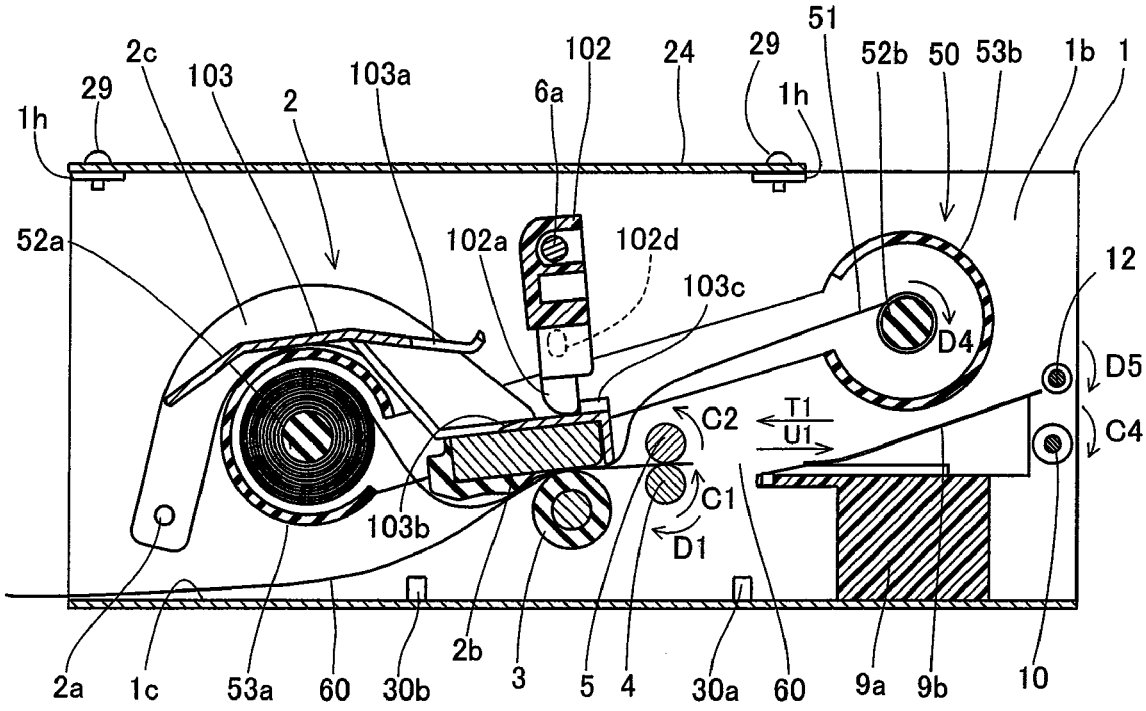

As shown in FIG. 29, a deviation preventing portion 103*c* is integrally formed on an end of the upper surface of the heat radiating member 103, in order to prevent the rotational portion 102 so rotated that the pressing portion 102*a* reaches the upper surface of the heat radiating member 103 from deviating in the rotational direction (along arrow F).

The remaining structure of the sublimatic printer 100 according to the second embodiment is similar to that of the aforementioned first embodiment.

According to the second embodiment, as hereinabove described, the sublimatic printer 100 is provided with the platen roller 3 opposed to the print head 2 and the heat radiating member 103 mounted on the print head 2 for radiating heat generated in the print head 2 while the heat radiating member 103 is integrally provided with the push-up portion 103*a* pushed up by the rotational portion 102 upon rotation of the rotational portion 102 and the rotational portion 102 pushes up the push-up portion 103*a* of the heat radiating member 103 upon rotation for moving the heat radiating member 103 and the print head 2 in the direction for separating from the platen roller 3 so that the rotational portion 102 pushes up the push-up portion 103*a* upon rotation thereof, whereby the heat radiating member 103 and the print head 2 can be easily rotated in the direction for separating from the platen roller 3 with no requirement for a transmission mechanism so provided as to transmit the rotational force of the rotational portion 102 to the heat radiating member 103 and the print head 2. Consequently, increase in the number of components can be further suppressed.

According to the second embodiment, the rotational portion 102 presses the print head 2 toward the platen roller 3 in printing while the heat radiating member 103 is provided with the deviation preventing portion 103*c* preventing the rotational portion 102 from deviating in the rotational direction when the rotational portion 102 presses the print head 2 toward the platen roller 3 in printing so that the rotational portion 102 does not deviate in the rotational direction in printing, thereby reliably pressing the print head 2 toward the platen roller 3.

According to the second embodiment, the body of the rotational portion 102 is made of resin, whereby noise caused in the rotational portion 102 when sliding with the shaft 6*a* of metal upon rotation can be suppressed as compared with a case where the rotational portion 102 is made of metal.

The remaining effects of the second embodiment are similar to those of the aforementioned first embodiment.

Although the present invention has been described and illustrated in detail, it is clearly understood that the same is by way of illustration and example only and is not to be taken by way of limitation, the spirit and scope of the present invention being limited only by the terms of the appended claims.

For example, while each of the aforementioned first and second embodiments is applied to the sublimatic printer employed as an exemplary image generating apparatus, the present invention is not restricted to this but is also applicable to an image generating apparatus other than the sublimatic printer, so far as the same has a print head pressing member pressing a print head.

While the thickness t1 of the contact portion of the second shaft stop portion along arrow X1 (see FIG. 12) is larger than the corresponding thickness t2 (see FIG. 12) of the second shaft stop portion in each of the aforementioned first and second embodiments, the present invention is not restricted but the thickness (t1 in FIG. 12) of the contact portion and the corresponding thickness (t2 in FIG. 12) of the second shaft stop portion may alternatively be equalized to each other so far as the shaft pressing portion of the shaft stop portion is elastically deformable along arrow X1.

What is claimed is:

1. An image generating apparatus comprising:

a chassis detachably mounted with an ink sheet cartridge storing an ink sheet and integrally provided with a first bearing;

a print head rotatably mounted on said chassis;

a print head pressing member, including a shaft held by said first bearing, pressing said print head;

a cartridge stop member provided on a first side surface of said chassis for engaging with said ink sheet cartridge thereby preventing said ink sheet cartridge from slipping off said chassis; and a side plate, provided on a second side surface of said chassis, integrally including at least a second bearing of a paper feed roller, wherein said cartridge stop member provided on said first side surface of said chassis integrally includes a first shaft stop portion coming into contact with a first end surface of said shaft of said print head pressing member, and said side plate provided on said second side surface of said chassis integrally includes a second shaft stop portion coming into contact with a second end surface of said shaft of said print head pressing member.

2. The image generating apparatus according to claim 1, wherein said second shaft stop portion includes a shaft pressing portion elastically deformable in a first direction intersecting with the axis of said shaft and pressed in said first direction by a peripheral surface of said shaft close to a second end thereof when said shaft is mounted on said first bearing of said chassis.

3. The image generating apparatus according to claim 1, wherein said first bearing of said chassis is constituted of an L-shaped notch, and said second shaft stop portion of said side plate further includes a contact portion provided on a position separated from a side surface of said shaft pressing portion closer to said shaft by a prescribed length outwardly from said shaft to be continuous with said shaft pressing portion for coming into contact with said second end surface of said shaft.

4. The image generating apparatus according to claim 3, wherein the thickness of said contact portion of said second shaft stop portion in said first direction intersecting with the axis of said shaft is larger than the corresponding thickness of said second shaft stop portion.

5. The image generating apparatus according to claim 1, wherein said second shaft stop portion is so formed that the width in the axial direction of said shaft is larger than the thickness in a direction intersecting with the axis of said shaft.

6. The image generating apparatus according to claim 1, wherein said first bearing includes an L-shaped notch having a vertically extending first portion and a second portion horizontally extending from said first portion, for holding said shaft in the vicinity of the forward end of said second portion of said L-shaped notch.

7. The image generating apparatus according to claim 1, further comprising:

a platen roller opposed to said print head, and a heat radiating member mounted on said print head for radiating heat generated in said print head, wherein said heat radiating member is integrally provided with a push-up portion pushed up by said print head pressing member upon rotation of said print head pressing member, and said print head pressing member so pushes up said push-up portion of said heat radiating member upon rotation of said print head pressing member as to move said heat radiating member and said print head in a direction for separating from said platen roller.

8. The image generating apparatus according to claim 7, wherein said print head pressing member presses said print head toward said platen roller in printing, and said heat radiating member includes a deviation preventing portion preventing said print head pressing member from deviating in the rotational direction when said print head pressing member presses said print head toward said platen roller in printing.

9. The image generating apparatus according to claim 1, wherein the body of said print head pressing member is made of resin.

10. An image generating apparatus comprising:

a chassis detachably mounted with an ink sheet cartridge storing an ink sheet;

a print head rotatably mounted on said chassis;

a first bearing, integrally provided on said chassis, constituted of an L-shaped notch;

a print head pressing member, including a shaft held by said first bearing, pressing said print head;

a cartridge stop member provided on a first side surface of said chassis for engaging with said ink sheet cartridge thereby preventing said ink sheet cartridge from slipping off said chassis; and a side plate, provided on a second side surface of said chassis, integrally including at least a second bearing of a paper feed roller, wherein said cartridge stop member provided on said first side surface of said chassis integrally includes a first shaft stop portion coming into contact with a first end surface of said shaft of said print head pressing member, said side plate provided on said second side surface of said chassis integrally includes a second shaft stop portion coming into contact with a second end surface of said shaft of said print head pressing member, said second shaft stop portion includes a shaft pressing portion elastically deformable in a first direction intersecting with the axis of said shaft and pressed in said first direction by a peripheral surface of said shaft close to a second end thereof when said shaft is mounted on said first bearing of said chassis, said second shaft stop portion of said side plate further includes a contact portion provided on a position separated from a side surface of said shaft pressing portion closer to said shaft by a prescribed length outwardly from said shaft to be continuous with said shaft pressing portion for coming into contact with said second end surface of said shaft, and the thickness of said contact portion of said second shaft stop portion in said first direction intersecting with the axis of said shaft is larger than the corresponding thickness of said second shaft stop portion.

11. The image generating apparatus according to claim 10, wherein said second shaft stop portion is so formed that the width in the axial direction of said shaft is larger than the width in said first direction intersecting with the axis of said shaft.

12. The image generating apparatus according to claim 10, wherein said first bearing includes said L-shaped notch having a vertically extending first portion and a second portion horizontally extending from said first portion, for holding said shaft in the vicinity of the forward end of said second portion of said L-shaped notch.

13. The image generating apparatus according to claim 10, further comprising:

a platen roller opposed to said print head, and a heat radiating member mounted on said print head for radiating heat generated in said print head, wherein said heat radiating member is integrally provided with a push-up portion pushed up by said print head pressing member upon rotation of said print head pressing member, and said print head pressing member so pushes up said push-up portion of said heat radiating member upon rotation of said print head pressing member as to move said heat radiating member and said print head in a direction for separating from said platen roller.

14. The image generating apparatus according to claim 13, wherein said print head pressing member presses said print head toward said platen roller in printing, and said heat radiating member includes a deviation preventing portion preventing said print head pressing member from deviating in the rotational direction when said print head pressing member presses said print head toward said platen roller in printing.

15. The image generating apparatus according to claim 10, wherein the body of said print head pressing member is made of resin.

* * * * *